US009244427B2

(12) United States Patent
Sato et al.

(10) Patent No.: US 9,244,427 B2
(45) **Date of Patent: *Jan. 26, 2016**

(54) IMAGE FORMING APPARATUS PROVIDED WITH CARTRIDGE FOR ACCOMMODATING WASTE TONER THEREIN

(71) Applicant: Brother Kogyo Kabushiki Kaisha, Nagoya, Aichi-ken (JP)

(72) Inventors: Shougo Sato, Seto (JP); Atsushi Fukui, Toyota (JP); Isao Fukuchi, Gifu (JP)

(73) Assignee: Brother Kogyo Kabushiki Kaisha, Nagoya, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/553,381

(22) Filed: Nov. 25, 2014

(65) Prior Publication Data

US 2015/0147089 A1 May 28, 2015

(30) Foreign Application Priority Data

Nov. 26, 2013 (JP) ..... 2013-243772

(51) Int. Cl.
*G03G 15/00* (2006.01)
*G03G 21/00* (2006.01)
(Continued)

(52) U.S. Cl.
CPC ..... *G03G 21/169* (2013.01); *G03G 15/0178* (2013.01); *G03G 21/0005* (2013.01);
(Continued)

(58) Field of Classification Search
CPC ..... G03G 15/166; G03G 21/1817; G03G 21/1839; G03G 21/1846; G03G 21/1853; G03G 2215/1647; G03G 2221/1624; G03G 2221/1807; G03G 2221/1846; G03G 2221/1869; G03G 21/169; G03G 21/0005; G03G 21/1623; G03G 21/1814; G03G 15/0178; G03G 2221/163; G03G 2221/183; G03G 2221/1684
USPC ..... 399/110, 111, 112, 113, 101, 358
See application file for complete search history.

(56) References Cited

U.S. PATENT DOCUMENTS 7,391,990 B2 * 6/2008 Fujii et al. ..... 399/110 X
8,116,662 B2 * 2/2012 Ohta ..... 399/358 X
(Continued)

FOREIGN PATENT DOCUMENTS

JP 2010-008472 A * 1/2010
JP 2010-102285 A 5/2010

OTHER PUBLICATIONS

Nov. 25, 2014—(US) Co-pending U.S. Appl. No. 14/553,134.
(Continued)

*Primary Examiner* — Sophia S Chen
(74) *Attorney, Agent, or Firm* — Banner & Witcoff, Ltd.

(57) ABSTRACT

An image forming apparatus includes a cartridge-supporting body, a belt, a belt cleaning unit, a waste toner cartridge, and a collective conveying unit. The cartridge-supporting unit supports a plurality of process cartridges. Each process cartridge includes a photosensitive drum and a drum-cleaning unit for collecting waste toner on the photosensitive drum. The belt confronts the plurality of process cartridges when the cartridge-supporting body is in an internal position. The belt cleaning unit collects waste toner on the belt. The waste toner cartridge accommodates both waste toner collected from the plurality of photosensitive drums by the plurality of drum-cleaning units and waste toner collected from the belt by the belt cleaning unit. The collective conveying unit aggregates waste toner collected from the plurality of photosensitive drums by the plurality of drum-cleaning units and conveys collectively the aggregated waste toner to the waste toner cartridge.

47 Claims, 11 Drawing Sheets

(51) Int. Cl.

| | |
|---|---|
| ***G03G 21/16*** | (2006.01) |
| ***G03G 15/01*** | (2006.01) |
| ***G03G 21/10*** | (2006.01) |
| ***G03G 21/18*** | (2006.01) |

(52) U.S. Cl.

CPC ..... *G03G21/105* (2013.01); *G03G 21/1623* (2013.01); *G03G 21/1814* (2013.01); *G03G 21/1853* (2013.01); *G03G 2215/1661* (2013.01); *G03G 2221/163* (2013.01); *G03G 2221/1684* (2013.01); *G03G 2221/183* (2013.01); *G03G 2221/1869* (2013.01)

(56) References Cited

U.S. PATENT DOCUMENTS

| | | | | |
|---|---|---|---|---|
| 8,548,354 | B2 | 10/2013 | Kikuchi | |
| 2005/0058475 | A1* | 3/2005 | Tsurusaki | 399/358 |
| 2006/0104663 | A1* | 5/2006 | Kitozaki | 399/111 |
| 2010/0074646 | A1* | 3/2010 | Miyahara et al. | 399/111 X |
| 2010/0080615 | A1 | 4/2010 | Kikuchi | |
| 2010/0119271 | A1* | 5/2010 | Akaike | 399/358 |
| 2010/0209157 | A1* | 8/2010 | Sato et al. | 399/343 |
| 2012/0315063 | A1 | 12/2012 | Kikuchi | |
| 2013/0223873 | A1* | 8/2013 | Manabe | 399/358 X |
| 2014/0044465 | A1* | 2/2014 | Mekada | 399/358 |

OTHER PUBLICATIONS

Nov. 25, 2014—(US) Co-pending U.S. Appl. No. 14/553,456.

May 19, 2015—(US) Ex Parte Quayle Office Action—U.S. Appl. No. 14/553,134.

May 19, 2015—(US) Non-Final Office Action—U.S. Appl. No. 14/553,456.

* cited by examiner

IMAGE FORMING APPARATUS PROVIDED WITH CARTRIDGE FOR ACCOMMODATING WASTE TONER THEREIN

CROSS REFERENCE TO RELATED APPLICATION

This application claims priority from Japanese Patent Application No. 2013-243772 filed Nov. 26, 2013. The entire content of the priority application is incorporated herein by reference.

TECHNICAL FIELD

The present invention relates to an image forming apparatus, particularly, an electro-photographic type image forming apparatus.

BACKGROUND

A tandem type image forming apparatus as an electro-photographic type image forming apparatus is known in which are provided a plurality of photosensitive drums, a transfer belt positioned in confrontation therewith, a plurality of process cartridges for a plurality of colors such as for example, yellow, magenta, cyan and black, and a drawer unit configured to support the process cartridges.

In such a tandem type image forming apparatus, each process cartridge is provided with a drum-cleaning unit configured to remove waste toner remaining on each photosensitive drum associated with each process cartridge, and a waste toner container configured to accumulate the waste toner removed by the drum-cleaning unit.

Further, Japanese patent application publication No. 2010-102285 discloses such a tandem type image forming apparatus in which a belt cleaning unit and a waste toner container are provided in an internal space of a frame of the device. The belt cleaning unit is positioned below the transfer belt and is configured to remove waste toner remaining on the transfer belt. The waste toner container is configured to accumulate waste toner removed by the belt cleaning unit.

SUMMARY

The above-disclosed image forming apparatus is bulky because each process cartridge is provided with the waste toner container for accumulating waste toner removed from the photosensitive drum, and the frame is provided with the waste toner container for accumulating waste toner removed from the transfer belt.

In view of the foregoing, it is an object of the present invention to provide a compact image forming apparatus yet capable of performing waste toner collection from a plurality of photosensitive drums and a belt.

In order to attain the above and other objects, the invention provides an image forming apparatus that may include a main frame, a plurality of process cartridges, a cartridge-supporting body, a belt, a belt cleaning unit, a waste toner cartridge, and a collective conveying unit. The plurality of process cartridges may include a plurality of photosensitive drums and a plurality of drum-cleaning units. The plurality of process cartridges may be provided in one-to-one correspondence with the plurality of photosensitive drums. The plurality of photosensitive drums may be provided in one-to-one correspondence with the plurality of drum-cleaning units. Each of the plurality of drum-cleaning units may be configured to collect waste toner on a corresponding photosensitive drum.

The cartridge-supporting body may be configured to support the plurality of process cartridges and movable between an internal position inside the main frame and an external position outside of the main frame. The belt may be configured to confront the plurality of process cartridges when the cartridge-supporting body supporting the plurality of process cartridges is in the internal position. The belt cleaning unit may be configured to collect waste toner on the belt. The waste toner cartridge may be configured to accommodate both waste toner collected from the plurality of photosensitive drums by the plurality of drum-cleaning units and waste toner collected from the belt by the belt cleaning unit. The collective conveying unit may be provided in the cartridge-supporting body and be configured to aggregate waste toner collected from the plurality of photosensitive drums by the plurality of drum-cleaning units and to convey collectively the aggregated waste toner to the waste toner cartridge.

According to another aspect, the present invention provides an image forming apparatus that may include a main frame, a plurality of developing cartridges, a drawer unit, a belt, a belt cleaning unit, a waste toner cartridge, and a collective conveying unit. Each of the plurality of developing cartridges may be configured to accommodate toner therein. The drawer unit may be configured to support the plurality of developing cartridges and be movable between an internal position inside the main frame and an external position outside of the main frame. The drawer unit may include a plurality of photosensitive drums and a plurality of drum-cleaning units provided in one-to-one correspondence with the plurality of photosensitive drums. Each of the plurality of drum-cleaning units may be configured to collect waste toner on a corresponding photosensitive drum. The belt may be configured to confront the plurality of photosensitive drums when the drawer unit supporting the plurality of developing cartridges is in the internal position. The belt cleaning unit may be configured to collect waste toner on the belt. The waste toner cartridge may be configured to accommodate both waste toner collected from the plurality of photosensitive drums by the plurality of drum-cleaning units and waste toner collected from the belt by the belt cleaning unit. The collective conveying unit may be provided in the drawer unit and be configured to aggregate waste toner collected from the plurality of photosensitive drums by the plurality of drum-cleaning units and to convey collectively the aggregated waste toner to the waste toner cartridge.

BRIEF DESCRIPTION OF THE DRAWINGS

The particular features and advantages of the invention as well as other objects will become apparent from the following description taken in connection with the accompanying drawings, in which.

DETAILED DESCRIPTION

1. Overall Structure of Printer

Figure 1:
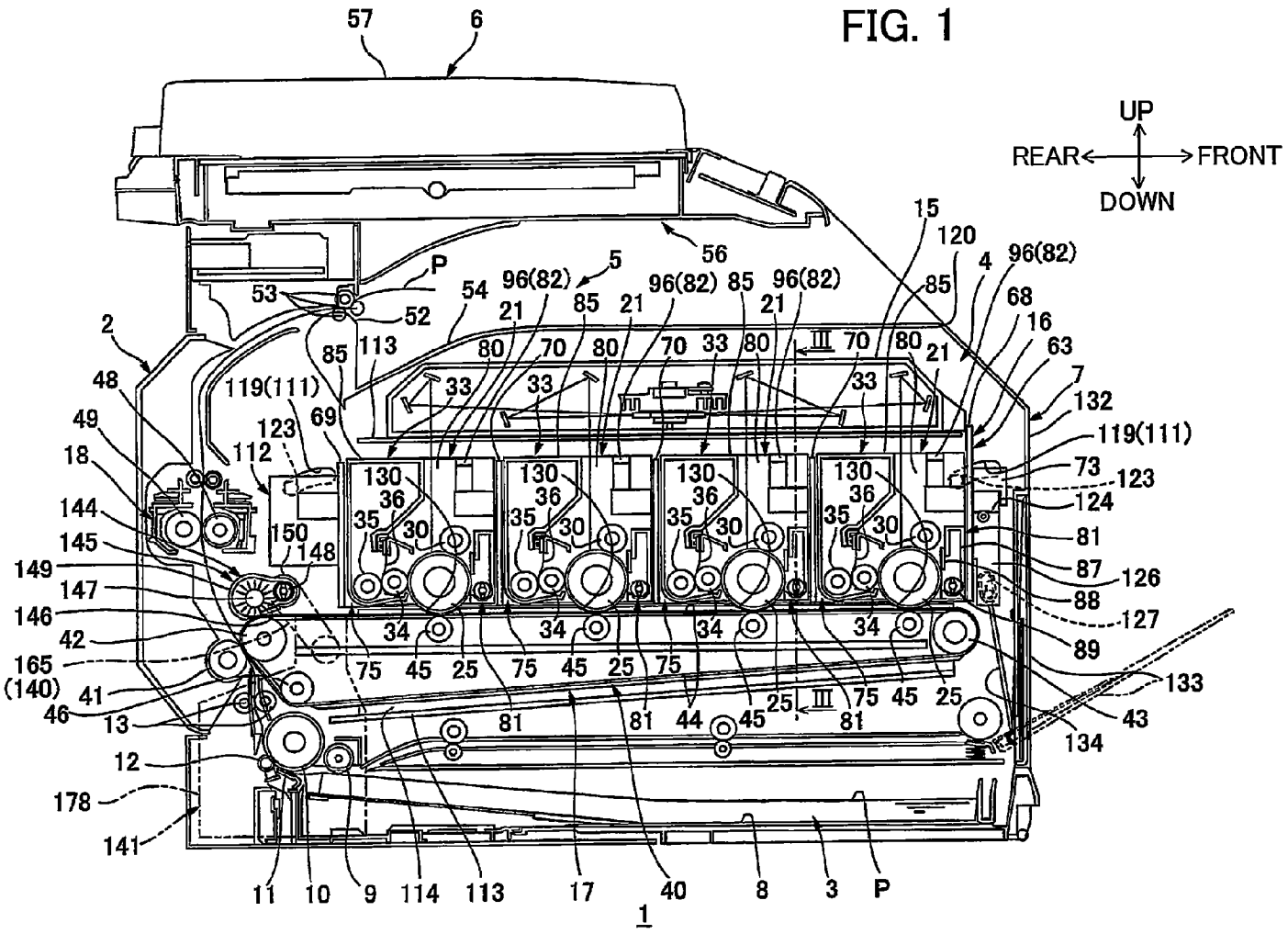
FIG. 1 is a cross-sectional view of a printer as an example of an image forming apparatus according to a first embodiment of the present invention and showing an internal contact position of a cartridge supporting body.

As shown in FIG. 1, a printer 1 as an example of an image forming apparatus is a transverse-mounted intermediate transfer type color printer. The printer 1 includes a main casing 2 as an example of a main frame, a sheet supply unit 3 for supplying a sheet P, an image forming unit 4 for forming an image on the sheet P, and a discharge unit 5 for discharging the image formed sheet P. These units 3, 4 and 5 are provided in an internal space of the main casing 2.

The printer 1 is also provided with an image reading unit 6 positioned above the main casing 2 for reading image data of an original.

(1) Main Casing

The main casing 2 is generally box shaped and is provided with a front cover 7. The main casing 2 has a front wall, and the front cover 7 is pivotally connected to a lower portion of the front wall and is movable to a closed position shown in FIG. 1 and an open position shown in FIG. 7 in order to permit a cartridge-supporting body 16 (described later) to slidingly move into an interior and an exterior of the main casing 2.

In the following description, the terms "upward", "downward", "upper", "lower", "above", "below", "beneath", "right", "left", "front", "rear" and the like will be used assuming that the printer 1 is disposed in a horizontal orientation in which it is intended to be used. In use, the printer 1 is disposed as illustrated in FIG. 1, in which a left side and a right side in FIG. 1 are a rear side and a front side, respectively, a far side and a near side in FIG. 1 are a right side and a left side, respectively, and a top side and a bottom side in FIG. 1 are a top side and a bottom side, respectively.

(2) Sheet Supply Unit

The sheet supply unit 3 includes a sheet supply tray 8 for accommodating a stack of sheets P, a pick-up roller 9, a sheet supply roller 10, a sheet supply pad 11, a pinch roller 12, and a pair of registration rollers 13. The pick-up roller 9 is configured to deliver a sheet P on the sheet supply tray 8 to a position between the sheet supply roller 10 and the sheet supply pad 11 by the rotation of the pick-up roller 9. The sheet supply roller 10 is adapted, by its rotation, to deliver each one of the sheets P in cooperation with the pinch roller 12 to the pair of registration rollers 13 positioned higher than the sheet supply roller 10. The pair of registration rollers 13 is adapted, by their rotation, to deliver the sheet P to a position between an intermediate transfer belt 44 (described later) and a secondary transfer roller 41 (described later) at a prescribed timing.

(3) Image Forming Portion

The image forming unit 4 includes a scanning unit 15, a plurality of process cartridges 21 (four cartridges), the cartridge-supporting body 16, a transfer unit 17, and a fixing unit 18.

The scanning unit 15 is positioned at an upper internal portion of the main casing 2. The scanning unit 15 is configured to emit laser beam based on image data toward a plurality of (four) photosensitive drums 25 (described later) as indicated by a solid line, so as to expose the photosensitive drums 25 to light to thus form an electrostatic latent image on an outer peripheral surface of the photosensitive drum 25.

The process cartridge 21 includes the photosensitive drum 25, a charging roller 30 for charging the outer peripheral surface of the photosensitive drum 25, and a developing unit 33 for supplying toner to the electrostatic latent image to form a toner image corresponding thereto.

The cartridge-supporting body 16 is positioned at vertically intermediate portion within the main casing 2 and below the scanning unit 15. The cartridge-supporting body 16 is configured to support the four process cartridges 21.

The transfer unit 17 is positioned at a lower portion within the main casing 2, and below the cartridge-supporting body 16 and above the sheet supply unit 3. The transfer unit 17 includes a belt unit 40 and the secondary transfer roller 41.

The belt unit 40 extends in frontward/rearward direction and is positioned below the four photosensitive drums 25. The belt unit 40 includes an intermediate transfer belt 44 as an example of a belt, a plurality of (four) primary transfer rollers 45 configured to sequentially transfer each toner image on each photosensitive drum 25 onto the intermediate transfer belt 44, a drive roller 42, a follow roller 43, and a tension roller 46. The intermediate transfer belt 44 is mounted over the drive roller 42 and the follow roller 43.

The secondary transfer roller 41 is positioned rearward of the drive roller 42 and nips the intermediate transfer belt 44 in cooperation with the drive roller 42. The secondary transfer roller 41 is configured to transfer a color image formed on the intermediate transfer belt 44 onto a sheet P supplied from the sheet supply unit 3. That is, secondary image transfer is performed by the secondary transfer roller 41.

The fixing unit 18 is positioned diagonally upward of the secondary transfer roller 41, and includes a heat roller 48 and a pressure roller 49 positioned rearward of the heat roller 48 and in pressure contact therewith. The fixing unit 18 is configured to thermally fix a toner image to the sheet P when the sheet P is moved past the heat roller 48 and the pressure roller 49.

(4) Sheet Discharge Portion

The sheet discharge unit 5 extends upward from a rear upper portion of the main casing 2, and has a discharge opening 52 and three discharge rollers 53 for discharging a sheet P fed from the fixing unit 18 onto a discharge tray 54.

The discharge opening 52 is positioned at a front end of the sheet discharge unit 5 and provides communication between the interior and exterior of the main casing 2. The three discharge rollers 53 are positioned to nip and guide the sheet P passing through the discharge opening 52. The discharge tray 54 is comparted at an upper surface of the main casing 2 and is positioned frontward of the sheet discharge unit 5.

(5) Image Reading Portion

The image reading unit 6 is positioned above the main casing 2 so as to cover the sheet discharge unit 5. The image reading unit 6 is generally rectangular shaped in planar view having a frontward/rearward length and leftward/rightward length approximately equal to those of the main casing 2. The image reading unit 6 includes an original stand 56 for mounting thereon an original, and a presser cover 57 pivotally movably supported to the original stand 56.

The image forming unit 4 is configured to form on a sheet P an image on the basis of image data read by the image reading unit 6.

2. Detailed Description of the Process Cartridges

Figure 3:
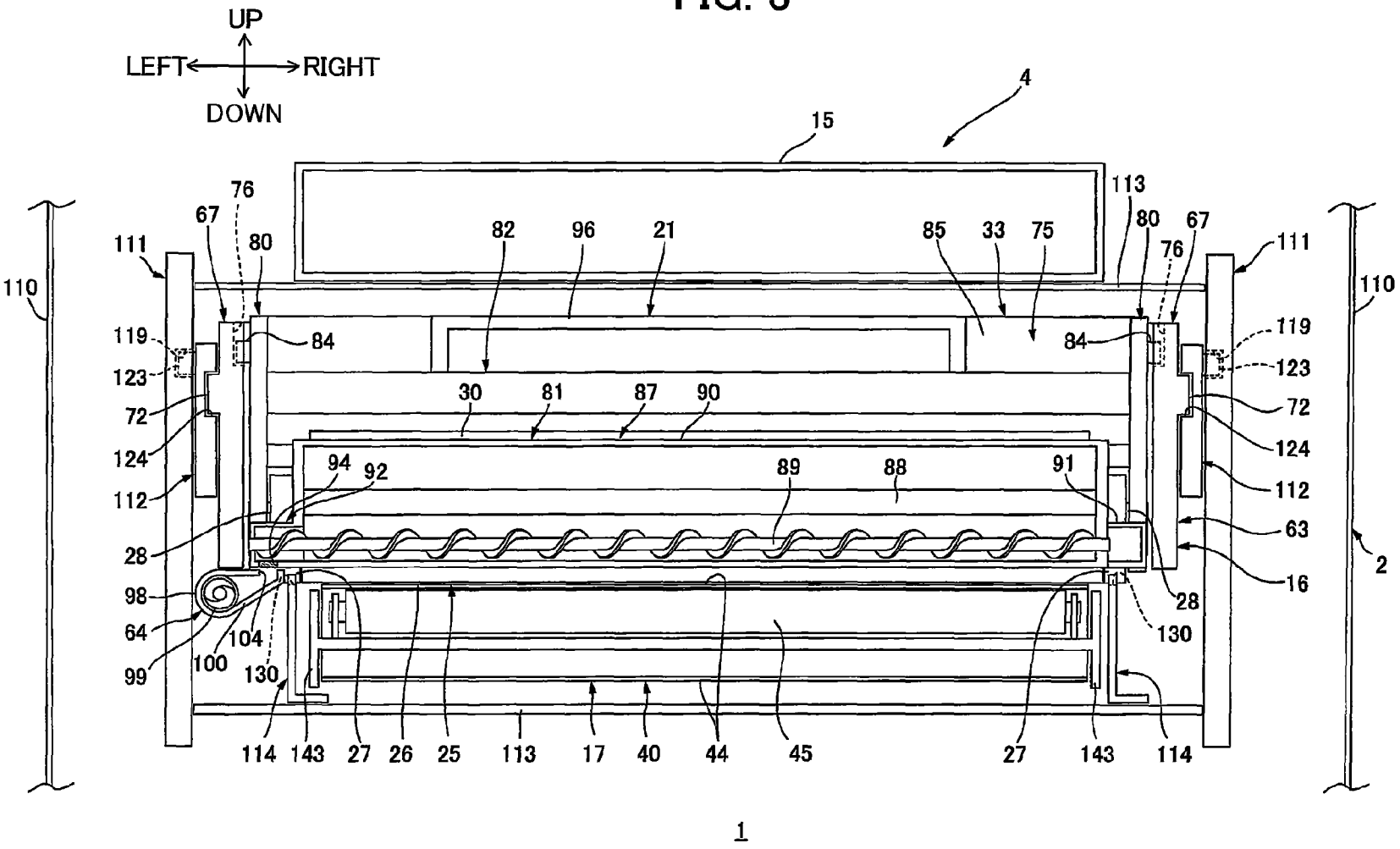
FIG. 3 is a cross-sectional view taken along a line III-III in FIG. 1 showing an assembled state of a process cartridge with respect to the cartridge supporting body.

As shown in FIGS. 1 and 3, in addition to the photosensitive drum 25, charging roller 30, and developing unit 33 described above, each process cartridge 21 includes a pair of side cartridge walls 80, a drum-cleaning unit 81 for collecting waste toner from the outer peripheral surface of the corresponding photosensitive drum 25, and a cartridge coupling rod 82.

(1) Side Cartridge Walls

Figure 2:
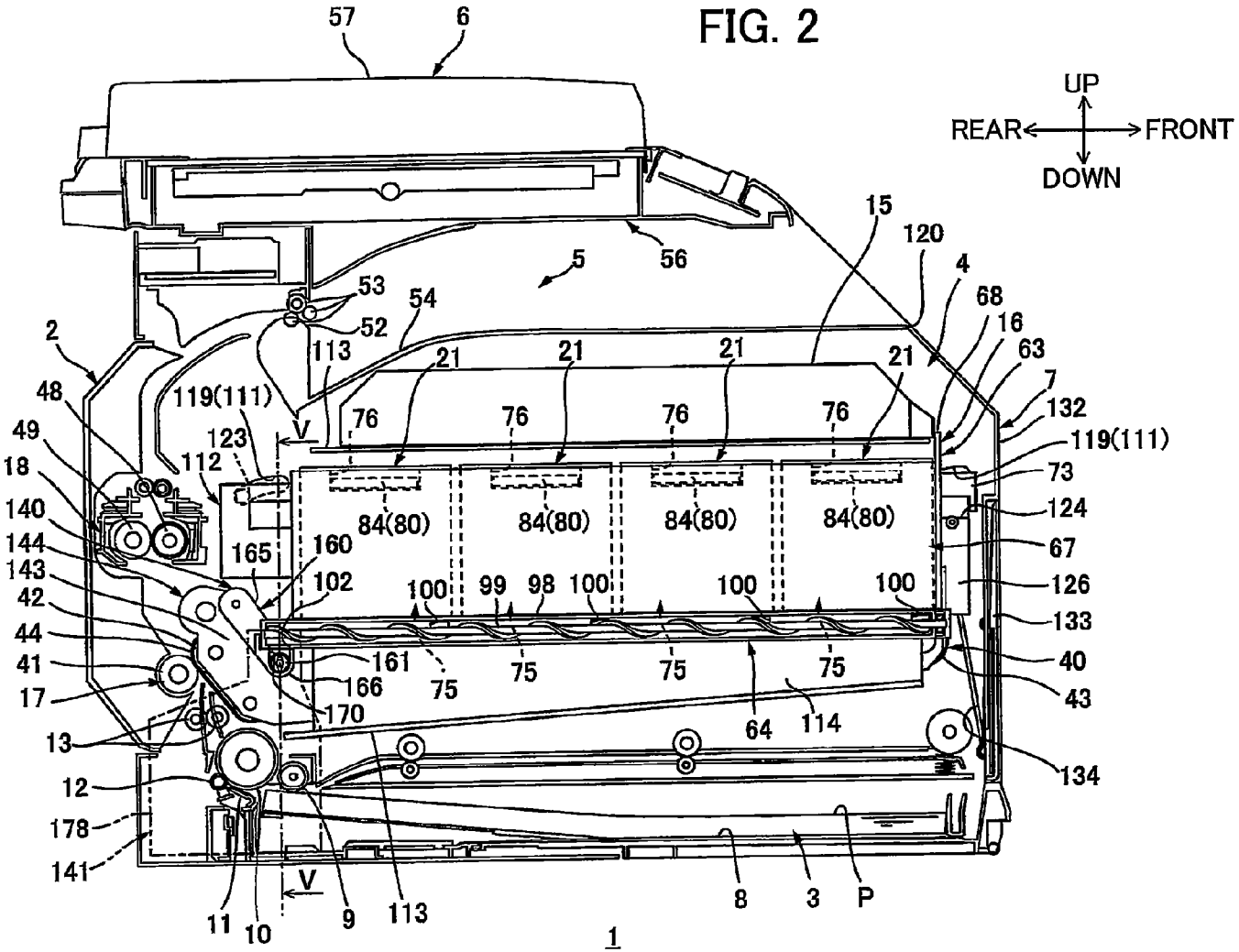
FIG. 2 is a cross-sectional view of the printer taken along a collective conveying unit when the internal contact position of the cartridge supporting body.

The side cartridge walls 80 are arranged so as to be separated in the left-right direction. The side cartridge walls 80 are plate-like and have a general rectangular shape in a side view that is elongated both vertically and in the front-rear direction. As shown in FIGS. 2 and 3, each side cartridge wall 80 has an engaging protrusion 84 for engaging in a corresponding receiving groove 76 of a support-body frame 63 described later.

The engaging protrusion 84 has a ridge-like shape that is elongated in the front-rear direction and protrudes outward in the left-right direction from the outer left-right surface of the corresponding side cartridge wall 80 in the upper portion thereof. The front-rear dimension of the engaging protrusion 84 is slightly smaller than the front-rear dimension of a receiving groove 76 described later.

(2) Photosensitive Drums

Figure 4:
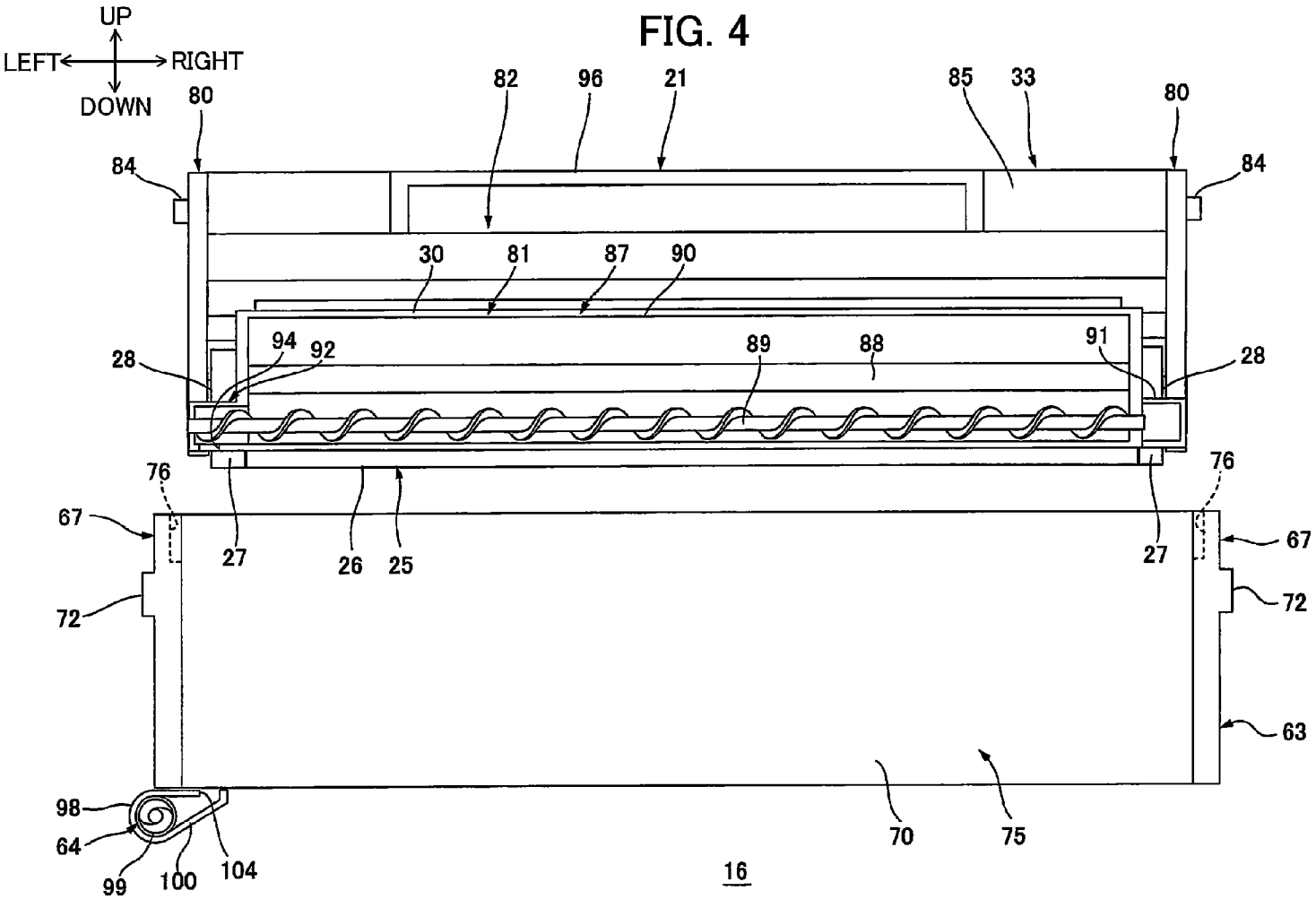
FIG. 4 is a cross-sectional view taken along the line III-III in FIG. 1 showing a disassembled state of the process cartridge with respect to the cartridge supporting body.

The photosensitive drum 25 is disposed in the bottom of the corresponding process cartridge 21 and is positioned in the approximate front-rear center region thereof. As shown in FIGS. 3 and 4, the photosensitive drum 25 includes a drum body 26, a pair of flanges 27, and a drum shaft 28.

The drum body 26 has a general cylindrical shape and is oriented with its axis aligned in the left-right direction. A photosensitive layer is formed over the outer peripheral surface of the drum body 26.

The flanges 27 have a general cylindrical shape with radial directions extending in vertical and front rear directions. The outer diameter of the flanges 27 is approximately equivalent to the outer diameter of the drum body 26. The flanges 27 are disposed one each on the left and right ends of the drum body 26.

The drum shaft 28 has a general columnar shape that is elongated in the left-right direction. The drum shaft 28 is inserted through the drum body 26 and the flanges 27. The left and right ends of the drum shaft 28 protrude outward in corresponding left and right directions from the flanges 27.

The photosensitive drum 25 is rotatably supported in the side cartridge walls 80 with the left and right ends of the drum shaft 28 supported in corresponding side cartridge walls 80.

(3) Charging Rollers

As shown in FIG. 1, the charging roller 30 is disposed on the upper front side of the corresponding photosensitive drum 25. The charging roller 30 has a general columnar shape and is oriented with its axis in the left-right direction. The lower rear surface of the charging roller 30 contacts the upper front surface of the corresponding photosensitive drum 25. As shown in FIGS. 3 and 4, the charging roller 30 is rotatably supported in the pair of side cartridge walls 80, with the left and right ends of the charging roller 30 supported in the corresponding side cartridge wall 80.

(4) Developing Units

As shown in FIG. 1, the developing unit 33 is disposed in the rear portion of the corresponding process cartridge 21 and functions to accommodate toner therein. Each developing unit 33 includes a developing-unit frame 85, a developing roller 34 for supplying toner onto the surface of the corresponding photosensitive drum 25, a supply roller 35 for supplying toner in the developing unit 33 to the corresponding developing roller 34, and a thickness-regulating blade 36 for regulating the thickness of toner supplied onto the developing roller 34.

The developing-unit frame 85 is arranged along the entire rear portion of the process cartridge 21 in the vertical direction. The developing-unit frame 85 has a general squared columnar shape and is elongated in the left-right direction. The left and right sides of the developing-unit frame 85 are respectively connected to the left-right inner surfaces on the rear portions of the corresponding side cartridge walls 80. The front wall of the developing-unit frame 85 has an opening formed in the lower edge thereof. The opening spans the entire left-right dimension of the developing-unit frame 85 and penetrates the front wall in the front-rear direction.

The developing roller 34 has a general columnar shape and is oriented with its axis in the left-right direction. The developing roller 34 is disposed in the lower front region of the corresponding developing unit 33, such that the front and upper surfaces of the developing roller 34 are exposed on the outside of the developing unit 33. The front surface of the developing roller 34 is in contact with the rear surface of the corresponding photosensitive drum 25. The developing roller 34 is disposed in the lower front region of the developing-unit frame 85 with both left and right ends supported in the side cartridge walls 80 such that the upper and front portions of its surface are exposed through the opening in the developing-unit frame 85.

The supply roller 35 has a general columnar shape and is oriented with its axis in the left-right direction. The supply roller 35 is disposed on the rear side of the corresponding developing roller 34 such that the front surface of the supply roller 35 contacts the rear surface of the developing roller 34 with pressure. The supply roller 35 is disposed in the lower rear region of the developing-unit frame 85 with both its left and right ends supported in the side cartridge walls 80.

The thickness-regulating blade 36 is disposed on the upper rear side of the corresponding developing roller 34. In a side view, the thickness-regulating blade 36 has a general plate shape that is oriented vertically. The bottom edge of the thickness-regulating blade 36 contacts the upper rear surface of the corresponding developing roller 34. The thickness-regulating blade 36 is fixed to the upper peripheral edge surrounding the opening in the developing-unit frame 85.

(5) Drum-Cleaning Unit

As shown in FIG. 1, each drum-cleaning unit 81 includes a drum-cleaning frame 87, a drum-cleaning blade 88 as an example of a drum cleaning member, and a drum-cleaning screw 89 as an example of a conveying member. Note that FIG. 1 shows reference numerals only for those members constituting the drum-cleaning unit 81 provided for the forwardmost process cartridge 21. Reference numerals have been omitted for those members constituting drum-cleaning units 81 provided for the other three process cartridges 21 to reduce confusion in the drawing.

(5-1) Drum-Cleaning Frame

The drum-cleaning frame 87 is disposed in the lower front region of the corresponding process cartridge 21 on the front side of the photosensitive drum 25. As shown in FIGS. 3 and 4, each drum-cleaning frame 87 includes a frame body 90, a right frame protrusion 91, and a left frame protrusion 92.

The frame body 90 has a general squared cylindrical shape that is elongated in the left-right direction and closed on both left and right ends. An opening that spans the entire left-right dimension of the frame body 90 is formed in the bottom portion of the rear wall constituting the frame body 90 and penetrates the rear wall in the front-rear direction.

The right frame protrusion 91 protrudes rightward from the right surface of the frame body 90 at the bottom region thereof. The right frame protrusion 91 has a general squared cylindrical shape that is closed on the right end.

The left frame protrusion 92 protrudes leftward from the left surface of the frame body 90 at the bottom edge thereof. The left frame protrusion 92 has a general squared cylindrical shape that is closed on the left end. The right end of the left frame protrusion 92 is connected to the frame body 90 such that the interior of the left frame protrusion 92 is in communication with the frame body 90. A communication hole 94 is also formed in the frame body 90 for discharging waste toner from the drum-cleaning frame 87.

The communication hole 94 is formed in a bottom portion of the left frame protrusion 92 at the left end thereof and penetrates the left frame protrusion 92 vertically to provide communication between the interior and exterior of the left frame protrusion 92.

The drum-cleaning frame 87 is supported in the pair of side cartridge walls 80 by connecting the right frame protrusion 91 to the right side cartridge wall 80 and by connecting the left frame protrusion 92 to the left side cartridge wall 80.

(5-2) Drum-Cleaning Blade

As shown in FIG. 1, the drum-cleaning blade 88 is disposed on the rear side of the corresponding drum-cleaning frame 87. The drum-cleaning blade 88 has a plate-like shape that is elongated in the left-right direction and has substantial thickness in the front-rear direction. The upper portion of the drum-cleaning blade 88 is fixed to the rear surface of the drum-cleaning frame 87, and specifically to the upper peripheral edge defining the opening formed in the drum-cleaning frame 87. The lower portion of the drum-cleaning blade 88 confronts the upper half of the opening formed in the drum-cleaning frame 87. The bottom edge of the drum-cleaning blade 88 contacts the front surface of the drum body 26 constituting the corresponding photosensitive drum 25.

(5-3) Drum-Cleaning Screw

The drum-cleaning screw 89 is disposed in the bottom region of the corresponding drum-cleaning frame 87. As shown in FIG. 3, the drum-cleaning screw 89 is a left-handed auger screw feeder having a rotational shaft that extends in the left-right direction. The right end of the rotational shaft constituting the drum-cleaning screw 89 is rotatably supported in the right wall of the frame body 90 constituting the drum-cleaning frame 87. The left end of the rotational shaft is rotatably supported in the left wall of the left frame protrusion 92.

As will be described later in greater detail, the drum-cleaning frame 87 is a conveying tube through which waste toner scraped off the corresponding drum body 26 by the drum-cleaning blade 88 can pass.

(6) Cartridge Coupling Rods

As shown in FIGS. 1 and 4, the cartridge coupling rod 82 of each process cartridge 21 spans between the front regions of the side cartridge walls 80 at a vertical position approximately one-third the vertical dimension of the side cartridge walls 80 from the top edges thereof. The cartridge coupling rods 82 have a general rod-like shape that is elongated in the left-right direction and has a general rectangular cross section. Each cartridge coupling rod 82 has a process handle 96 that the user can grip when mounting the process cartridge 21 in and removing the process cartridge 21 from the support-body frame 63 described later.

The process handle 96 is disposed in the approximate left-right center region on the top surface of the corresponding cartridge coupling rod 82. The process handle 96 has a general plate shape and, in a front side view, has a general squared U-shape, with the opening of the "U" facing downward.

3. Detailed Description of the Cartridge-Supporting Body

As shown in FIGS. 2 and 3, the cartridge-supporting body 16 includes a support-body frame 63 for supporting the four process cartridges 21, a collective conveying unit 64 for consolidating and conveying waste toner removed from all four process cartridges 21 by the respective drum-cleaning units 81.

(1) Support-Body Frame

The support-body frame 63 is a frame-like member having a general rectangular shape in a plan view. As shown in FIG. 1, the support-body frame 63 includes a pair of side support-body walls 67 (see FIG. 3), a front support-body wall 68, a rear support-body wall 69, and three partitioning support-body walls 70.

Figure 7:
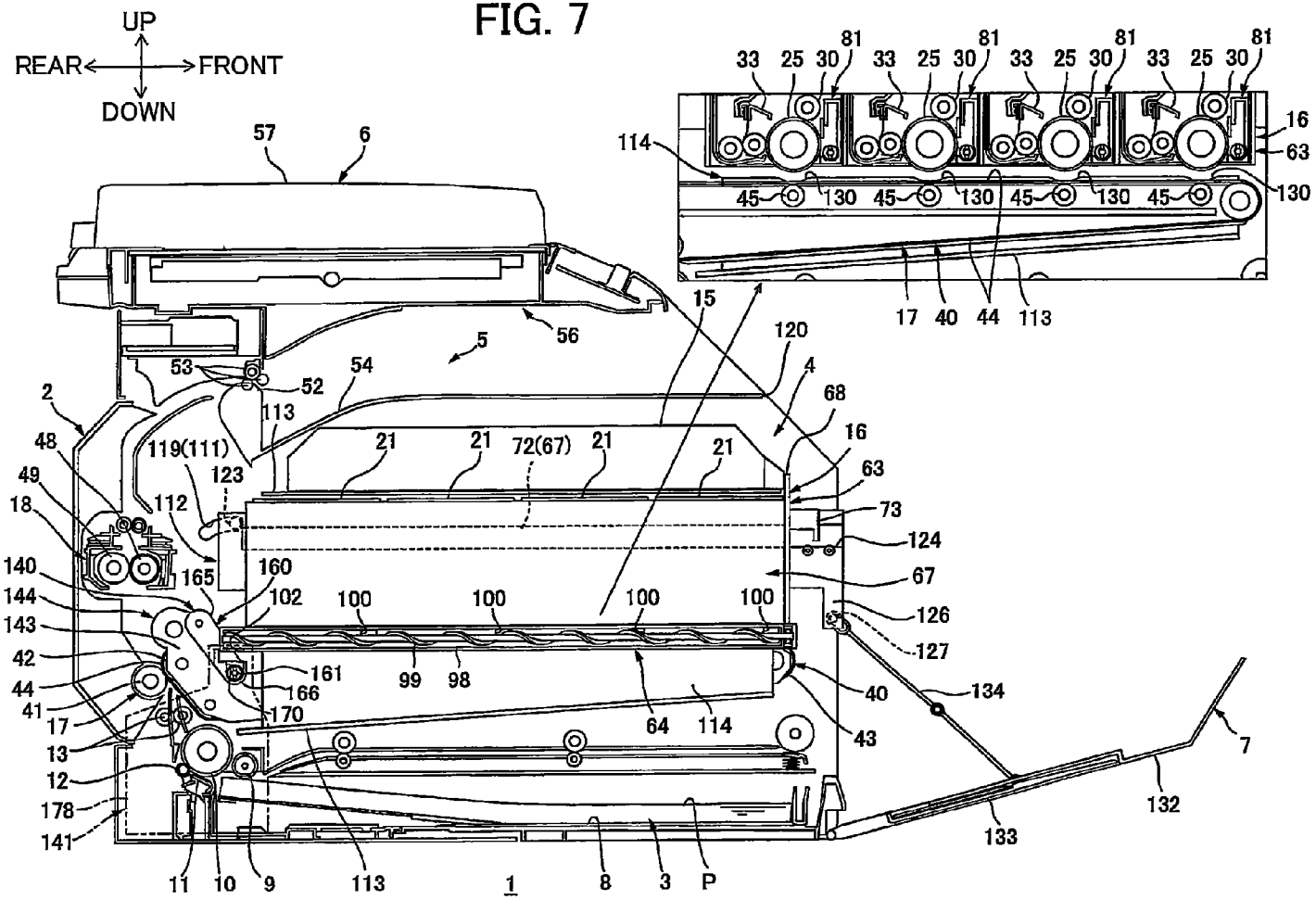
FIG. 7 is a view corresponding to FIG. 2 and showing an internal separated position of the cartridge supporting body.

As shown in FIG. 3, the side support-body walls 67 are separated from each other in the left-right direction. The left side support-body wall 67 is an example of the first side wall, and the right side support-body wall 67 is an example of the second side wall. The side support-body walls 67 are plate-like and have a general rectangular shape in a side view that is elongated in the front-rear direction. As shown in FIGS. 3 and 7, each side support-body wall 67 includes a guide rail 72. The guide rail 72 is a ridge-like member that spans the entire front-rear dimension of the corresponding side support-body wall 67. The guide rail 72 protrudes outward in the left-right direction at a position approximately one-third the vertical dimension of the side support-body wall 67 from the top edge of the same.

As shown in FIG. 1, the front support-body wall 68 bridges the front edges of the side support-body walls 67. The front support-body wall 68 is a plate-like member having a general rectangular shape in a front side view and is elongated in the left-right direction. The top edge of the front support-body wall 68 protrudes above the side support-body walls 67. The front support-body wall 68 includes a drawer handle 73 that the user grips when moving the support-body frame 63 relative to the main casing 2.

The drawer handle 73 is a plate-like member having a general L-shape in a side view. Specifically, the drawer handle 73 protrudes first forward from the front surface on the upper portion of the front support-body wall 68, and then bends downward.

The rear support-body wall 69 bridges the rear edges of the side support-body walls 67. The rear support-body wall 69 is a plate-like member having a general rectangular shape in a front side view and is elongated in the left-right direction.

The three partitioning support-body walls 70 are arranged parallel to each other at intervals in the front-rear direction between the front support-body wall 68 and rear support-body wall 69 so as to bridge the side support-body walls 67. The partitioning support-body walls 70 are plate-like members having a general rectangular shape in the front-rear direction and are elongated in the left-right direction.

Figure 8:
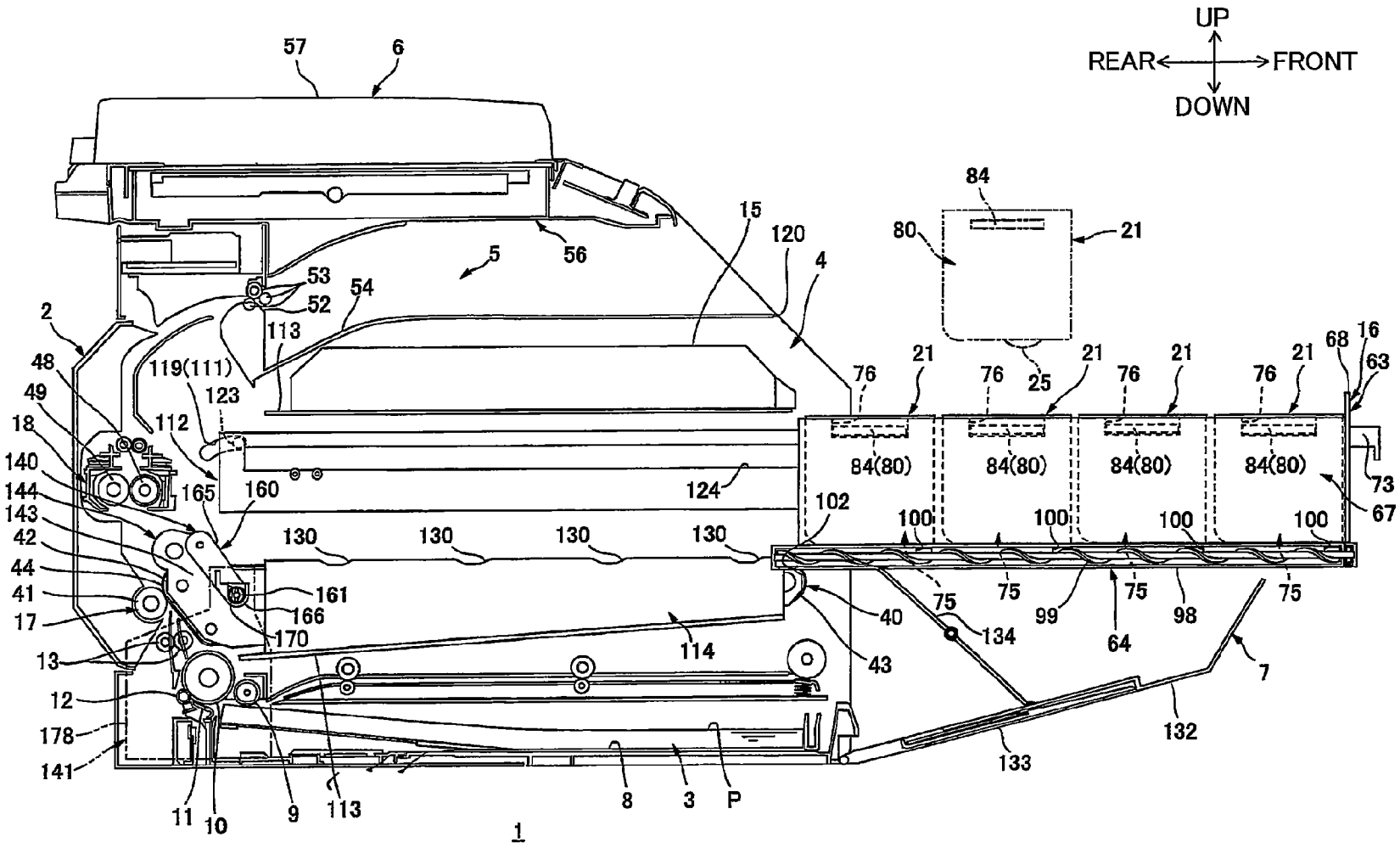
FIG. 8 is a view corresponding to FIG. 2 and showing an external position of the cartridge supporting body.

Spaces in the support-body frame 63 formed between adjacent partitioning support-body walls 70 and the pair of side support-body walls 67 are defined as process-cartridge accommodating sections 75. In addition, the space in the front region of the support-body frame 63 defined by the front support-body wall 68, the forwardmost partitioning support-body wall 70, and the pair of side support-body walls 67 is also defined as a process-cartridge accommodating section 75, while the space in the rear region of the support-body frame 63 defined by the rear support-body wall 69, the rearmost partitioning support-body wall 70, and the side support-body walls 67 is also defined as a process-cartridge accommodating section 75. Hence, four process-cartridge accommodating sections 75 are juxtaposed in the front-rear direction. As illustrated in FIGS. 4 and 8, the four process cartridges 21 are configured to be detachably mountable in corresponding process-cartridge accommodating sections 75 formed in the support-body frame 63.

As shown in FIGS. 2 and 3, receiving grooves 76 are provided one in each side support-body wall 67 within each of the four process-cartridge accommodating sections 75 for receiving the corresponding engaging protrusions 84 of the side cartridge wall 80.

The receiving grooves 76 are recesses formed in the inner left-right surfaces of the corresponding side support-body walls 67. In a plan view, the receiving grooves 76 have a squared U-shape that is open on the inner left-right side and the top. Four of the receiving grooves 76 are formed in each of the side support-body walls 67 at intervals in the front-rear direction. The front-rear dimension of the receiving grooves 76 is shorter than the front-rear dimension of the process-cartridge accommodating sections 75.

As will be described later in greater detail, the support-body frame 63 can be moved by sliding in the front-rear direction, i.e., in the direction that the photosensitive drums 25 are juxtaposed, between an internal position shown in FIGS. 1 and 7 inside the main casing 2, and an external position shown in FIG. 8 outside the main casing 2. Further, while the process cartridges 21 are mounted in the support-body frame 63, the support-body frame 63 can be moved between a contact position shown in FIG. 1 in which the photosensitive drums 25 are in contact with the intermediate transfer belt 44, and a separated position shown in FIG. 7 in which the photosensitive drums 25 are separated from the intermediate transfer belt 44.

As shown in FIG. 3, the bottom of the support-body frame 63 is positioned above the bottoms of the drum bodies 26 and the bottoms of the flanges 27 constituting the photosensitive drums 25 when the support-body frame 63 is in the internal position with the process cartridges 21 mounted therein.

(2) Collective Conveying Unit

As shown in FIGS. 2 and 3, the collective conveying unit 64 includes a collective conveying tube 98, four input cylinders 100 as examples of the plurality of cylindrical parts for receiving waste toner from the corresponding drum-cleaning units 81, and a collective conveying screw 99 as an example of the collective conveying member for consolidating and conveying waste toner received through the input cylinders 100.

(2-1) Collective Conveying Tube

Figure 5:
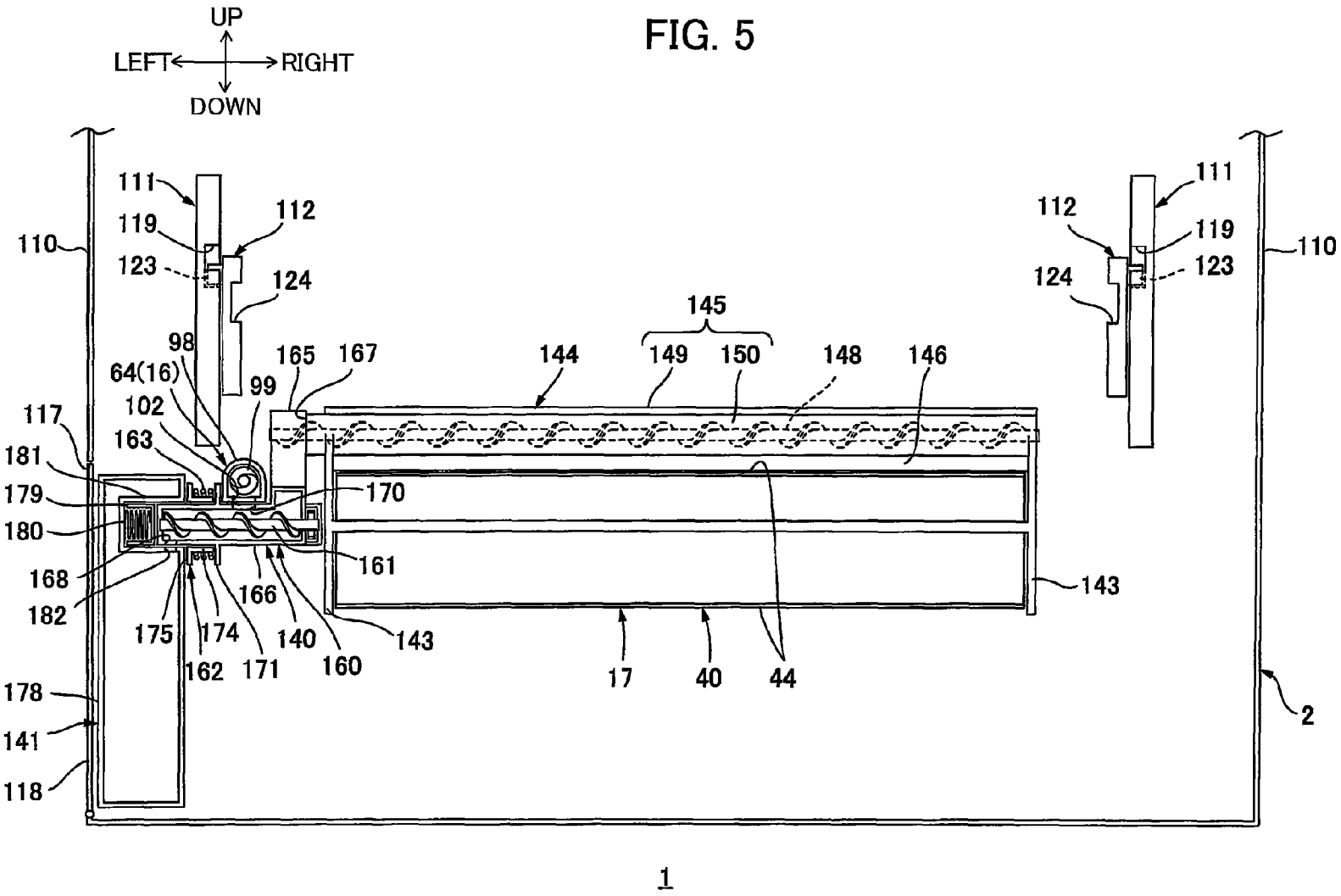
FIG. 5 is a cross-sectional view taken along a line V-V in FIG. 2 showing an assembled state of a waste toner cartridge with respect to a coupling unit.

The collective conveying tube 98 has a general cylindrical shape that is elongated in the front-rear direction and closed on both front and rear ends. The collective conveying tube 98 is disposed below the left side support-body wall 67 and is supported on the bottom edge of the left side support-body wall 67, the bottom left end of the front support-body wall 68, and the bottom left end of the rear support-body wall 69. Thus, in a vertical projection, the collective conveying tube 98 overlaps the left side support-body wall 67. The front end of the collective conveying tube 98 extends farther forward than the front side of the support-body frame 63, and the rear end of the collective conveying tube 98 extends farther rearward than the rear side of the support-body frame 63. As shown in FIG. 5, the portion of the collective conveying tube 98 positioned rearward of the rear side of the support-body frame 63 is flattened on the bottom and aligned in the left-right direction. The collective conveying tube 98 includes a consolidated toner ejection opening 102 for ejecting waste toner collected and conveyed by the collective conveying unit 64 out of the collective conveying unit 64.

As shown in FIGS. 2 and 5, the consolidated toner ejection opening 102 is formed in the bottom of the collective conveying tube 98 in the portion positioned rearward of the rear side of the support-body frame 63. The consolidated toner ejection opening 102 penetrates the bottom portion of the collective conveying tube 98 vertically to provide communication between the interior and exterior of the collective conveying tube 98.

(2-2) Input Cylinders

As shown in FIGS. 2 and 3, the four input cylinders 100 are arranged at intervals in the front-rear direction. The input cylinders 100 protrude rightward from the right circumferential surface of the collective conveying tube 98 and have a general squared cylindrical shape that is closed on the right side. More specifically, as shown in FIGS. 3 and 4, the input cylinders 100 have an upper portion that is aligned in the left-right direction and a lower portion that slopes upward toward the right. Accordingly, the vertical dimension of the input cylinders 100 grows smaller toward the right. The left side of each input cylinder 100 is connected to the collective conveying tube 98 so that the interior of the input cylinder 100 is in communication with the collective conveying tube 98. Each input cylinder 100 has an inlet 104 for receiving waste toner discharged through the communication hole 94 of the corresponding drum-cleaning unit 81.

The inlet 104 is formed in the right end portion of the input cylinder 100 and penetrates the upper portion of the input cylinder 100 vertically to provide communication between the interior and exterior of the input cylinder 100.

As shown in FIG. 3, the inlet 104 formed in each of the four input cylinders 100 vertically overlaps the communication hole 94 formed in the corresponding drum-cleaning unit 81 when the process cartridges 21 are mounted in the support-body frame 63. Through this construction, the drum-cleaning frame 87 of each drum-cleaning unit 81 is in communication with the collective conveying tube 98 of the collective conveying unit 64.

(2-3) Collective Conveying Screw

As shown in FIGS. 2 and 3, the collective conveying screw 99 is disposed inside the collective conveying tube 98. The collective conveying screw 99 is a right-handed auger screw feeder having a rotational shaft aligned in the front-rear direction. The front and rear ends of the rotational shaft in the collective conveying screw 99 are rotatably supported in the corresponding front and rear walls of the collective conveying tube 98.

As will be described later in greater detail, the collective conveying tube 98 functions to allow passage of waste toner removed from the drum bodies 26 and introduced through the four input cylinders 100.

4. Detailed Description of Main Casing (1) Frame Structure of Main Casing

The main casing 2 includes a pair of outer casing side walls 110, a pair of inner casing side walls 111, a pair of guiding walls 112, a pair of side-wall connecting plates 113, a pair of positioning plates 114 as examples of a positioning member, and the front cover 7 described above.

(1-1) Outer Casing Side Walls

Figure 6:
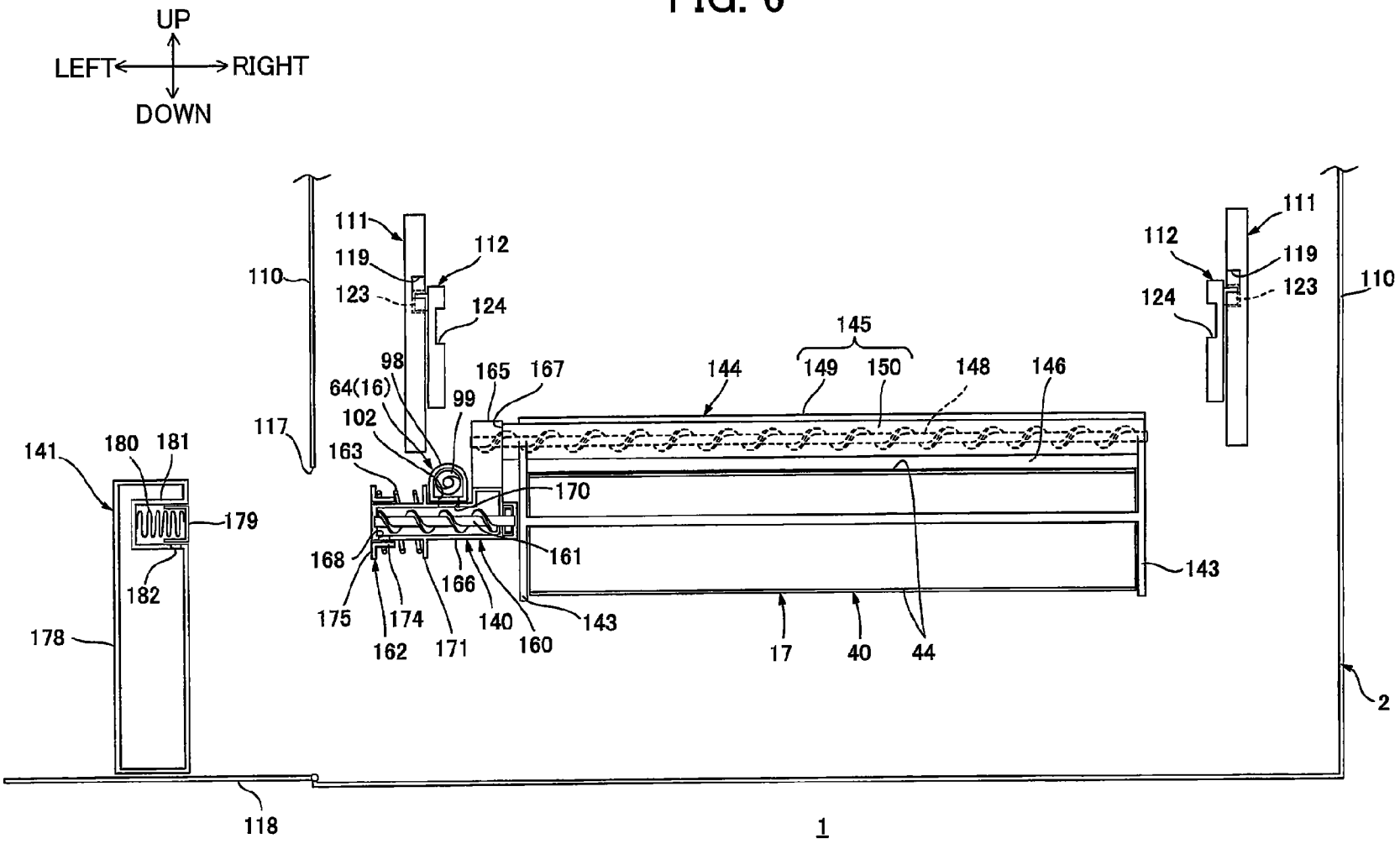
FIG. 6 is a cross-sectional view taken along the line V-V in FIG. 2 showing a disassembled state of a waste toner cartridge with respect to the coupling unit.

The outer casing side walls 110 are spaced apart from each other in the left-right direction. The outer casing side walls 110 are plate-like members having a general rectangular shape in a side view and are elongated in the front-rear direction. As shown in FIGS. 5 and 6, the left outer casing side wall 110 includes a waste-toner-unit access opening 117, and a side cover 118.

The waste-toner-unit access opening 117 penetrates the lower rear portion of the left outer casing side wall 110 in the left-right direction. The waste-toner-unit access opening 117 has dimensions sufficient for allowing passage of a waste toner cartridge 141 described later.

The side cover 118 is a plate-like member having a general rectangular shape in a side view. The side cover 118 can be pivoted about the bottom edge of the waste-toner-unit access opening 117 between a closed position shown in FIG. 5, and an open position shown in FIG. 6.

(1-2) Inner Casing Side Walls

As shown in FIG. 3, the inner casing side walls 111 are spaced apart from each other in the left-right direction and are disposed further inward than the outer casing side walls 110 in the left-right direction. The inner casing side walls 111 are plate-like members having a rectangular shape in a side view and are elongated in the front-rear direction. As shown in FIGS. 1 and 3, each of the inner casing side walls 111 has a pair of front and rear curved grooves 119.

The curved grooves 119 are spaced apart from each other in the front-rear direction and are disposed at positions approximately one-fourth the vertical dimension of the corresponding inner casing side wall 111 from the top edge of the same. The curved grooves 119 are recessed into the inner left-right surface of the corresponding inner casing side wall 111. As shown in FIG. 1, the curved grooves 119 have a uniform width and extend in a direction sloping upward toward the front. The center region of the curved groove 119 is deflected slightly upward to the rear to give the curved groove 119 a general arc shape in a side view.

A cartridge-support-body access opening 120 is defined as the space between the front ends of the inner casing side walls 111. The cartridge-support-body access opening 120 penetrates the front wall of the main casing 2 in the front-rear direction.

(1-3) Guiding Walls

As shown in FIG. 3, the guiding walls 112 are spaced apart from each other in the left-right direction and are disposed at positions further inward in the left-right direction from the corresponding inner casing side walls 111. As shown in FIGS. 1 and 3, the guiding walls 112 are plate-like members having a rectangular shape in a side view and are elongated in the front-rear direction. Each guiding wall 112 includes a guiding groove 124, an extended part 126, an engaging shaft 127, and a pair of front and rear guiding shafts 123.

The guiding groove 124 is a recess formed in the inner left-right surface of the guiding wall 112 at a position approximately one-third the vertical dimension of the guiding wall 112 from the top edge of the same and extends from the front edge of the guiding wall 112 to a position near the rear edge. The guiding groove 124 receives the guide rail 72 on the corresponding side support-body wall 67 of the support-body frame 63 so that the guide rail 72 can slide in the front-rear direction.

As shown in FIG. 1, the extended part 126 is a plate-like member having a general rectangular shape in a side view. The extended part 126 protrudes downward from the lower front edge of the guiding wall 112.

The engaging shaft 127 has a general columnar shape and protrudes outward in the left-right direction from the outer left-right surface of the corresponding extended part 126 near the bottom edge thereof. The engaging shaft 127 engages with the distal end of an interlocking part 134 (described later) of the front cover 7.

The guiding shafts 123 are spaced apart from each other in the front-rear direction, with one disposed on the upper front end and one on the upper rear end of the corresponding guiding wall 112. As shown in FIGS. 1 and 3, the guiding shafts 123 have a general columnar shape and protrude outward in the left-right direction from the outer left-right surface of the corresponding guiding wall 112. Each of the guiding shafts 123 is inserted into the corresponding curved groove 119 formed in the inner casing side wall 111 and is capable of moving within the curved groove 119.

With this configuration, the guiding walls 112 are capable of translating relative to the inner casing side wall 111 in a direction diagonally upward and forward, with the guiding shafts 123 moving within the corresponding curved grooves 119 of the inner casing side walls 111 from the lower rear ends of the curved grooves 119 to the upper front ends.

(1-4) Side-Wall Connecting Plates

As shown in FIGS. 1 and 3, the side-wall connecting plates 113 bridge the upper ends and the lower ends of the inner casing side walls 111. The upper side-wall connecting plate 113 is disposed beneath the scanning unit 15, while the lower side-wall connecting plate 113 is disposed beneath the transfer unit 17 and above the sheet supply unit 3. The lower side-wall connecting plate 113 has a plate-like shape that slopes upward from the rear side toward the front side so as to follow the bottom portion of the intermediate transfer belt 44.

(1-5) Positioning Plates

As shown in FIGS. 2 and 3, the positioning plates 114 are disposed on the top surface of the lower side-wall connecting plate 113, with one on the left portion of the side-wall connecting plate 113 and one on the right portion. The left positioning plate 114 overlaps the collective conveying tube 98 of the collective conveying unit 64 in the left-right direction and is positioned on the right side of the collective conveying tube 98 when the support-body frame 63 is in the internal position. In other words, the collective conveying tube 98 is positioned outside of the left positioning plate 114 with respect to the left-right direction. The positioning plates 114 are plate-like members having a general rectangular shape in a side view and are elongated in the front-rear direction. The bottom ends of the positioning plates 114 are bent rightward so as to slope upward from the rear side toward the front side. The top edges of the positioning plates 114 are aligned in the front-rear direction. Each positioning plate 114 includes four positioning recesses 130.

The four positioning recesses 130 are spaced at intervals along the front-rear direction. The positioning recesses 130 are recesses formed in the top edges of the positioning plates 114 and have a general arc shape in a side view. The positioning recesses 130 are shaped to conform with the peripheral edges of the flanges 27 constituting the photosensitive drums 25. In a left-right projection, the bottom edges of the positioning recesses 130 are approximately aligned with the upper portion of the intermediate transfer belt 44.

(1-6) Front Cover

As described above, the front cover 7 can pivot between the closed position shown in FIG. 1, and the open position shown in FIG. 7. As shown in FIG. 1, the front cover 7 includes a cover body 132, a manual feed tray 133, and an interlocking part 134.

The cover body 132 is a plate-like member having a general rectangular shape in a front view and is elongated vertically, with the upper end sloping rearward. The cover body 132 has dimensions sufficient for covering the cartridge-support-body access opening 120.

The manual feed tray 133 is disposed in the approximate vertical center region of the cover body 132. The manual feed tray 133 is a plate-like member having a general rectangular shape in a side view and is elongated in the left-right direction. The manual feed tray 133 can be rotated forward and downward about the bottom edge of the cover body 132.

As shown in FIGS. 1 and 7, the interlocking part 134 has a general rod shape that is capable of folding in the approximate center region of its longitudinal dimension. The base end of the interlocking part 134 is connected to the approximate vertical center of the cover body 132. The distal end of the interlocking part 134 is engaged with the engaging shaft 127 on the guiding wall 112.

(2) Cleaning Configuration in the Main Casing

As shown in FIGS. 1 and 5, the belt unit 40 described above, a waste toner cartridge 141, and a coupling unit 140 that couples the waste toner cartridge 141 to the belt unit 40 are provided on the main casing 2.

(2-1) Belt Unit

The belt unit 40 extends in the front-rear direction and is positioned beneath all of the photosensitive drums 25. The belt unit 40 includes the drive roller 42, the follow roller 43, the tension roller 46, and the intermediate transfer belt 44 and the primary transfer rollers 45 described earlier.

The drive roller 42 is rotatably supported in the rear end of the belt unit 40. The follow roller 43 is rotatably supported in the front end of the belt unit 40. The tension roller 46 is rotatably supported in the belt unit 40 at a position below and forward of the drive roller 42.

The intermediate transfer belt 44 is looped around the drive roller 42, the follow roller 43, and the tension roller 46 so that its top portion contacts the bottom surfaces of all photosensitive drums 25. As the drive roller 42 drives and the follow roller 43 follows, the intermediate transfer belt 44 circulates such that its top portion moves forward. The tension roller 46 serves to apply tension to the intermediate transfer belt 44 by pressing downward on the bottom portion of the intermediate transfer belt 44.

The four primary transfer rollers 45 are disposed inside the loop formed by the intermediate transfer belt 44 and are arranged at intervals in the front-rear direction between the drive roller 42 and follow roller 43. The primary transfer rollers 45 are positioned beneath the corresponding photosensitive drums 25, with the top portion of the intermediate transfer belt 44 interposed therebetween so that the primary transfer rollers 45 contact the upper portion of the intermediate transfer belt 44 from below.

The belt unit 40 further includes side belt unit plates 143, and a belt-cleaning unit 144 for removing waste toner from the surface of the intermediate transfer belt 44.

(2-1-1) Side Belt Unit Plates

As shown in FIGS. 2 and 3, the side belt unit plates 143 constitute the left and right ends of the belt unit 40. The side belt unit plates 143 are spaced apart from each other in the left-right direction and are positioned inside the corresponding positioning plates 114 in the left-right direction. The side belt unit plates 143 are plate-like members having a general rectangular shape in a side view and are elongated in the front-rear direction. The top edges of the side belt unit plates 143 are aligned in the front-rear direction, while the bottom edges slope upward from the rear side toward the front side along the slope of the side-wall connecting plates 113. The rear ends of the side belt unit plates 143 protrude upward and function to close the left and right ends of a belt-cleaning frame 145 (described later).

(2-1-2) Belt-Cleaning Unit

As shown in FIG. 1, the belt-cleaning unit 144 is disposed above the drive roller 42, with the intermediate transfer belt 44 interposed therebetween. Thus, the belt-cleaning unit 144 is positioned farther rearward than the rearmost photosensitive drum 25 when the support-body frame 63 is in the internal position and supports the process cartridges 21. The belt-cleaning unit 144 includes a belt-cleaning frame 145, a belt-cleaning blade 146 as an example of a belt cleaning member, a belt-cleaning brush roller 147, and a belt-cleaning screw 148 as an example of a conveying member.

The belt-cleaning frame 145 further includes a brush roller accommodating section 149, and a screw accommodating section 150.

As shown in FIG. 5, the brush roller accommodating section 149 has a general cylindrical shape that is elongated in the left-right direction. The side belt unit plates 143 close the left and right ends of the brush roller accommodating section 149. An opening is formed in the bottom of the brush roller accommodating section 149 and vertically penetrates the bottom of the brush roller accommodating section 149 across its entire left-right dimension.

As shown in FIGS. 1 and 5, the screw accommodating section 150 has a general cylindrical shape and is elongated in the left-right direction. The screw accommodating section 150 is adjacent to the brush roller accommodating section 149 on the front side, with its interior in communication with the interior of the brush roller accommodating section 149. The screw accommodating section 150 has a smaller diameter than the brush roller accommodating section 149. As shown in FIG. 5, the right side belt unit plate 143 closes the right end of the screw accommodating section 150. Thus, the right end of the screw accommodating section 150 is flush with the right end of the brush roller accommodating section 149. The left end of the screw accommodating section 150 extends farther leftward than the left end of the brush roller accommodating section 149. In other words, the screw accommodating section 150 has a greater left-right direction than the brush roller accommodating section 149.

As shown in FIG. 1, the belt-cleaning blade 146 is disposed in the lower front portion of the brush roller accommodating section 149. The belt-cleaning blade 146 is a plate-like member that is elongated in the left-right direction and has substantial thickness along a direction that slopes upward toward the rear. The upper front portion of the belt-cleaning blade 146 is fixed to the front peripheral edge of the brush roller accommodating section 149 defining the opening in the bottom of the same. The lower rear portion of the belt-cleaning blade 146 confronts the front half of the opening formed in the brush roller accommodating section 149. The lower rear edge of the belt-cleaning blade 146 contacts the top surface of the intermediate transfer belt 44 near the rear end thereof.

The belt-cleaning brush roller 147 is disposed inside the brush roller accommodating section 149. The belt-cleaning brush roller 147 is a brush roller having a flocked surface and has a rotational shaft aligned in the left-right direction. The left and right ends of the rotational shaft in the belt-cleaning brush roller 147 are rotatably supported in the side belt unit plates 143 that close the left and right ends of the brush roller accommodating section 149.

The belt-cleaning screw 148 is disposed in the screw accommodating section 150. As shown in FIG. 5, the belt-cleaning screw 148 is a left-handed auger screw feeder having a rotational shaft that is oriented in the left-right direction.

The right end of the rotational shaft in the belt-cleaning screw 148 is rotatably supported in the coupling unit 140 that closes the right end of the screw accommodating section 150. The left end of the rotational shaft in the belt-cleaning screw 148 protrudes farther leftward than the left end of the screw accommodating section 150 and is rotatably supported in the left wall of a first portion 165 constituting a coupling tube 160 described later.

As will be described later in greater detail, the belt-cleaning frame 145 is a conveying tube configured to allow passage of waste toner that has been scraped off the intermediate transfer belt 44 by the belt-cleaning blade 146.

(2-2) Coupling Unit

As shown in FIGS. 2 and 5, the coupling unit 140 is disposed leftward of the rear side of the transfer unit 17. The coupling unit 140 includes a coupling tube 160 as an example of the coupling conveyance tube, a coupling screw 161, a sliding part 162, and a coupling-unit spring 163.

(2-2-1) Coupling Tube

As shown in FIG. 5, the coupling tube 160 has a first portion 165, and a second portion 166.

As shown in FIGS. 2 and 5, the first portion 165 has a general squared cylindrical shape that is elongated in a direction angled upward to the rear. The upper rear end of the first portion 165 is closed. As shown in FIG. 5, the first portion 165 includes a first coupling hole 167 as an example of a first opening. The first coupling hole 167 receives toner from the belt-cleaning unit 144.

The first coupling hole 167 is formed in the upper end of the first portion 165 and penetrates the right wall of the first portion 165 in the left-right direction. The peripheral part of the first coupling hole 167 is connected to the left end of the screw accommodating section 150 constituting the belt-cleaning frame 145 described above. Through this construction, the first portion 165 is connected to the screw accommodating section 150 so that its interior is in communication with the interior of the screw accommodating section 150.

The second portion 166 has a general cylindrical shape that extends leftward from the bottom end portion of the first portion 165. Both left and right ends of the second portion 166 are closed. The upper portion of the second portion 166 is connected to the first portion 165 at the right end thereof so that the interior of the second portion 166 is in communication with the interior of the first portion 165. The second portion 166 further includes a second coupling hole 168 as an example of a third opening for discharging waste toner from the coupling unit 140, a collective receiving opening 170 as an example of a second opening for receiving waste toner from the collective conveying unit 64, and a contact part 171.

The second coupling hole 168 is formed in the left end portion of the second portion 166, penetrating the bottom portion of the second portion 166 vertically so as to provide communication between the interior and exterior of the second portion 166.

The collective receiving opening 170 is formed in the approximate left-right center region of the second portion 166 and penetrates the upper portion of the second portion 166 vertically so as to provide communication between the interior and exterior of the second portion 166.

Hence, the first coupling hole 167, second coupling hole 168, and collective receiving opening 170 are all in communication with the interior of the coupling tube 160.

The contact part 171 has a general angular shape that protrudes outward along a radial direction of the second portion 166 from the outer peripheral surface of the second portion 166 in a position between the second coupling hole 168 and collective receiving opening 170.

(2-2-2) Coupling Screw

The coupling screw 161 is disposed inside the second portion 166. The coupling screw 161 is a right-handed auger screw with a rotational shaft that extends in the left-right direction. The left and right ends of the rotational shaft in the coupling screw 161 are rotatably supported in the left and right walls of the second portion 166.

As shown in FIG. 5, the sliding part 162 is provided on the left end of the second portion 166. The sliding part 162 includes a sliding cylinder 174, and a flange part 175.

The sliding cylinder 174 has a general cylindrical shape that is elongated in the left-right direction. The sliding cylinder 174 can receive the second portion 166 therein.

The flange part 175 has a general annular shape and is formed around the left end of the sliding cylinder 174 so as to protrude radially outward from the outer peripheral surface of the sliding cylinder 174.

The coupling-unit spring 163 is a wire that has been wound in a helical shape whose axis extends in the left-right direction. The right end of the coupling-unit spring 163 is in contact with the contact part 171. The left end of the coupling-unit spring 163 is in contact with the flange part 175 constituting the sliding part 162.

As will be described later in greater detail, the coupling tube 160 is a conveying tube that allows passage of both waste toner that has been scraped off the drum bodies 26 by the corresponding drum-cleaning blades 88 and waste toner that has been scraped off the intermediate transfer belt 44 by the belt-cleaning blade 146.

(2-3) Waste Toner Cartridge

As shown in FIGS. 1 and 5, the waste toner cartridge 141 is disposed on the left end of the coupling unit 140. That is, the waste toner cartridge 141 is disposed farther rearward than the rearmost photosensitive drum 25 when the support-body frame 63 that supports the process cartridges 21 is in the internal position. The waste toner cartridge 141 is detachably mounted on the coupling unit 140. As shown in FIG. 5, the waste toner cartridge 141 includes a waste toner box 178, an enclosing member 179, and a waste-toner-unit spring 180.

The waste toner box 178 has a box-like shape that is elongated in the vertical and front-rear directions. The top end of the waste toner box 178 protrudes upward. The waste toner box 178 includes a receiving part 181 for receiving the second portion 166 of the coupling unit 140, and a waste toner inlet 182 for receiving waste toner from the coupling unit 140.

The receiving part 181 is a depression formed in the right wall of the waste toner box 178 in the upper protruding part. The receiving part 181 has a general circular shape in a side view. The left end of the receiving part 181 is positioned farther leftward than the approximate left-right center of the waste toner box 178.

The waste toner inlet 182 vertically penetrates the bottom portion of the receiving part 181 near the right end thereof.

The enclosing member 179 has a general cylindrical shape that is elongated in the left-right direction and is closed on the right end. The enclosing member 179 is disposed inside the waste toner inlet 182.

The waste-toner-unit spring 180 is configured of a wire that has been wound in a helical shape whose axis is aligned in the left-right direction. The right end of the waste-toner-unit spring 180 contacts the inner left surface of the enclosing member 179, and the left end of the waste-toner-unit spring 180 is in contact with the inner left end of the receiving part 181.

With the waste toner cartridge 141 having the above structure, the waste-toner-unit spring 180 is compressed leftward when the second portion 166 is received in the receiving part 181, positioning the enclosing member 179 on the left side of the waste toner inlet 182. Further, the peripheral region of the receiving part 181 on the right side of the waste toner box 178 contacts the left side of the flange part 175, thereby urging the sliding part 162 rightward so as to compress the coupling-unit spring 163 rightward.

In this state, the waste toner inlet 182 is vertically aligned with the second coupling hole 168 formed in the coupling unit 140. Thus, the waste toner box 178 of the waste toner cartridge 141 is in communication with the coupling tube 160 of the coupling unit 140.

(2-4) Mounting and Removal of Waste Toner Cartridge Relative to Coupling Unit

The waste toner cartridge 141 can be inserted into and removed from the coupling unit 140 through the waste-toner-unit access opening 117.

To remove the waste toner cartridge 141 from the coupling unit 140, first the user exposes waste-toner-unit access opening 117 by pivoting the side cover 118 of the outer casing side wall 110 leftward and downward about its bottom edge, as shown in FIG. 6. Next, the user pulls the waste toner cartridge 141 leftward through the waste-toner-unit access opening 117 until the second portion 166 of the coupling unit 140 is extracted from the receiving part 181 of the waste toner cartridge 141. Through this operation, the waste toner inlet 182 is no longer in communication with the second coupling hole 168.

At this time, the urging force of the waste-toner-unit spring 180 in the waste toner cartridge 141 pushes the enclosing member 179 rightward. Consequently, the enclosing member 179 is moved to the right end of the receiving part 181 so that its outer circumferential surface blocks the waste toner inlet 182.

In addition, the urging force of the coupling-unit spring 163 in the coupling unit 140 pushes the sliding part 162 leftward. Consequently, the sliding part 162 is moved to the left end portion of the second portion 166 constituting the coupling tube 160 so that the inner circumferential surface of the sliding cylinder 174 blocks the second coupling hole 168.

To mount the waste toner cartridge 141 in the coupling unit 140, the steps of the above operation are performed in reverse. That is, the user pushes the waste toner cartridge 141 into the main casing 2 through the waste-toner-unit access opening 117 so that the receiving part 181 receives the second portion 166, as shown in FIG. 5. Through this operation, the enclosing member 179 in the waste toner cartridge 141 is moved leftward in the receiving part 181 against the urging force of the waste-toner-unit spring 180. At the same time, the sliding part 162 in the coupling unit 140 is moved rightward along the outer circumferential surface of the second portion 166 against the urging force of the coupling-unit spring 163.

Through this operation, the waste toner inlet 182 is now aligned vertically with the second coupling hole 168 so that the waste toner box 178 of the waste toner cartridge 141 is in communication with the coupling tube 160 of the coupling unit 140.

5. State of the Support-Body Frame in the Contact Position

As shown in FIGS. 1 and 3, the support-body frame 63 is slidably supported in the main casing 2 while the process cartridges 21 are mounted in the support-body frame 63, with the guide rails 72 inserted in the guiding grooves 124 of the guiding walls 112. When the support-body frame 63 is in the internal position, the rear surface on the top edge of the front support-body wall 68 constituting the support-body frame 63 is in contact with the front end of the scanning unit 15.

Here, the guiding shafts 123 of the guiding walls 112 are positioned in the lower rear ends of the corresponding curved grooves 119 formed in the inner casing side walls 111. Accordingly, the photosensitive drums 25 in the four process cartridges 21 supported in the support-body frame 63 are in contact with the top edges of the positioning plates 114. More specifically, the flanges 27 on the four photosensitive drums 25 are received in the corresponding positioning recesses 130.

Thus, the positioning plates 114 position the four photosensitive drums 25 so that the drum bodies 26 are in contact with the upper portion of the intermediate transfer belt 44 and are positioned relative to the scanning unit 15. At this time, the support-body frame 63 is in the internal position, and specifically the contact position (hereinafter this will be called the "internal contact position").

Note that when the support-body frame 63 is in the internal contact position while the process cartridges 21 are mounted therein, the consolidated toner ejection opening 102 formed in the collective conveying unit 64 is vertically aligned with the collective receiving opening 170 formed in the coupling unit 140, as shown in FIGS. 2 and 5. Consequently, the collective conveying tube 98 of the collective conveying unit 64 is in communication with the coupling tube 160 of the coupling unit 140.

6. Operations for Recovering Waste Toner from Photosensitive Drums and Intermediate Transfer Belt Next, the operations of the printer 1 will be described for collecting waste toner from the photosensitive drums 25 and the intermediate transfer belt 44.

(1) Waste Toner Collection Operations of Drum Cleaning Unit and Collective Conveying Unit The drum-cleaning unit 81 removes waste toner and other matter deposited on the drum body 26 of the corresponding photosensitive drum 25. More specifically, the drum-cleaning blade 88 scrapes waste toner and other deposited matter from the drum body 26 of the corresponding photosensitive drum 25, and this deposited matter is collected in the drum-cleaning frame 87, as shown in FIGS. 1 and 3. The drum-cleaning screw 89 in the drum-cleaning frame 87 rotates so as to convey the waste toner and other deposited matter accumulated in the drum-cleaning frame 87 toward the left end of the drum-cleaning frame 87 and, hence, toward the left frame protrusion 92.

Deposited matter conveyed to the left frame protrusion 92 passes through the communication hole 94 and inlet 104 and falls into the input cylinder 100. In the input cylinder 100, the deposited matter continues to flow into the collective conveying tube 98.

With the collective conveying screw 99 rotating in the collective conveying tube 98, as shown in FIG. 2, the collective conveying unit 64 then conveys the waste toner and other deposited matter removed from the drum bodies 26 of the photosensitive drums 25 and introduced into the collective conveying tube 98 rearward. Hence, waste toner and other deposited matter removed from the drum bodies 26 of the photosensitive drums 25 by the corresponding drum-cleaning units 81 can be collected in the collective conveying tube 98 through the four input cylinders 100 and conveyed altogether.

As shown in FIGS. 2 and 5, waste toner and other deposited matter removed from the drum bodies 26 of the photosensitive drums 25 and consolidated in the collective conveying tube 98 drop through the consolidated toner ejection opening 102 and collective receiving opening 170 and flow into the second portion 166 of the coupling tube 160.

(2) Waste Toner Collection Operation of Belt-Cleaning Unit

The belt-cleaning unit 144 removes waste toner and other matter deposited on the intermediate transfer belt 44. As shown in FIGS. 1 and 5, the belt-cleaning blade 146 scrapes waste toner and other deposited matter off the intermediate transfer belt 44, and the deposited matter is collected in the brush roller accommodating section 149 of the belt-cleaning frame 145.

The rotating belt-cleaning brush roller 147 then conveys the waste toner and other deposited matter collected in the brush roller accommodating section 149 toward the front side of the belt-cleaning frame 145 and, hence, toward the screw accommodating section 150.

The belt-cleaning screw 148 in the screw accommodating section 150 rotates to convey the waste toner and other deposited matter toward the left end of the screw accommodating section 150. In this way, waste toner and other deposited matter removed from the intermediate transfer belt 44 and conveyed to the left end of the screw accommodating section 150 passes through the first coupling hole 167 and flows into the first portion 165 of the coupling tube 160.

(3) Conveyance of Waste Toner by Coupling Unit

The coupling unit 140 collects waste toner and other deposited matter removed from the drum bodies 26 of the photosensitive drums 25 by the corresponding drum-cleaning units 81 and waste toner and other deposited matter removed from the intermediate transfer belt 44 by the belt-cleaning unit 144 inside the coupling tube 160 and conveys this deposited matter toward the waste toner cartridge 141. More specifically, waste toner and other deposited matter removed from the intermediate transfer belt 44 is conveyed into the first portion 165 by the belt-cleaning screw 148 of the belt-cleaning unit 144 and drops down through the first portion 165 into the right end of the second portion 166. Next, the rotating coupling screw 161 conveys the waste toner and other deposited matter removed from the intermediate transfer belt 44 toward the left end of the second portion 166.

At this time, the waste toner and other deposited matter removed from the intermediate transfer belt 44 and introduced into the left end portion of the second portion 166 by the belt-cleaning unit 144 and the waste toner and other deposited matter removed from the drum bodies 26 of the four photosensitive drums 25 and introduced into the left end portion of the second portion 166 by the collective conveying unit 64 in the approximate left-right center region of the second portion 166, and all deposited matter is conveyed together toward the left end of the second portion 166.

Hence, all waste toner and other deposited matter removed from the intermediate transfer belt 44 and from the drum bodies 26 of the photosensitive drums 25 is conveyed together to the left end portion of the second portion 166, passed through the second coupling hole 168 and waste toner inlet 182, and collected in the waste toner box 178 of the waste toner cartridge 141.

Thus, all waste toner and other deposited matter removed from the intermediate transfer belt 44 and from the drum bodies 26 of the photosensitive drums 25 and passed separately through the intermediate transfer belt 44 and collective conveying unit 64, respectively, can be stored together in the waste toner box 178 of the waste toner cartridge 141.

7. Operations for Moving Cartridge Support Body (1) Moving Cartridge Support Body from Internal Position to External Position First, the operations for moving the cartridge-supporting body 16 from the internal contact position to the separated position will be described.

While the cartridge-supporting body 16 is in the internal contact position inside the main casing 2, as shown in FIG. 2, the user moves the front cover 7 of the main casing 2 from its closed position to its open position. Through this operation, the cartridge-supporting body 16 moves from the contact position to the separated position shown in FIG. 7. Specifically, as the front cover 7 moves from the closed position to the open position, the front cover 7 applies a tensile force to the interlocking part 134 and pulls the left guiding wall 112 forward via the interlocking part 134. Through this operation, the guiding shafts 123 move within the corresponding curved grooves 119 of the inner casing side walls 111 from the lower rear end to the upper front end, causing the guiding walls 112 to move upward and forward.

The cartridge-supporting body 16 moves upward in the main casing 2 along with the movement of the guiding walls 112. As a result, the four photosensitive drums 25 separate from the four positioning recesses 130 provided in each positioning plate 114. The collective conveying unit 64 also moves upward relative to the coupling unit 140 at this time, removing communication between the consolidated toner ejection opening 102 of the collective conveying tube 98 and the collective receiving opening 170 of the coupling tube 160. This operation completes movement of the cartridge-supporting body 16 from the internal contact position to the internal separated position.

Next, movement of the cartridge-supporting body 16 from the internal separated position to the external position will be described.

While the cartridge-supporting body 16 is in the separated position shown in FIG. 7, the user grips the drawer handle 73 and pulls the cartridge-supporting body 16 forward from the internal position (internal separated position) to the external position shown in FIG. 8. At this time, the cartridge-supporting body 16 slides forward with the guide rails 72 guided in the guiding grooves 124. In this way, the user pulls the cartridge-supporting body 16 out of the main casing 2 through the cartridge-support-body access opening 120, as shown in FIG. 8.

This completes the operation to move the cartridge-supporting body 16 from the internal separated position to the external position. Once the cartridge-supporting body 16 has been placed in the external position in this way, the user can pull the process cartridges 21 upward to remove them from the support-body frame 63 of the cartridge-supporting body 16, as illustrated in phantom in FIG. 8.

(2) Moving Cartridge-Supporting Body from External Position to Internal Position First, the operation for moving the cartridge-supporting body 16 from the external position to the internal separated position will be described.

When the user pushes the cartridge-supporting body 16 rearward, the cartridge-supporting body 16 slides from the external position to the separated position while the guide rails 72 are guided in the guiding grooves 124. Once the cartridge-supporting body 16 arrives in the separated position, the rear surface on the top edge of the front support-body wall 68 constituting the support-body frame 63 contacts the front side of the scanning unit 15, as shown in FIG. 7. At this time, the four photosensitive drums 25 are positioned above their corresponding positioning recesses 130 while being separated vertically therefrom.

This completes the operation to move the support-body frame 63 from the external position to the internal separated position.

Next, the operation to move the cartridge-supporting body 16 from its internal separated position to the internal contact position will be described.

To perform this operation, the user moves the front cover 7 from its open position to its closed position. As the front cover 7 moves toward the closed position, the tensile force that the interlocking part 134 applies to the guiding walls 112 is cancelled. Accordingly, the guiding walls 112 move downward by their own weight as the guiding shafts 123 move to the lower rear ends of the corresponding curved grooves 119. Since the front support-body wall 68 of the support-body frame 63 is in contact with the front end of the scanning unit 15 at this time, the guiding walls 112 move downward without moving rearward.

Consequently, the four photosensitive drums 25 are received in the corresponding positioning recesses 130 and positioned thereby while being in contact with the intermediate transfer belt 44, as shown in FIG. 1.

At the same time, the collective conveying unit 64 approaches the coupling unit 140 until the consolidated toner ejection opening 102 formed in the collective conveying tube 98 is vertically aligned and in communication with the collective receiving opening 170 formed in the coupling tube 160.

This completes the operation to move the support-body frame 63 from its separated position to its contact position.

8. Operational Advantages (1) As shown in FIG. 2, the printer 1 includes the main casing 2, the four process cartridges 21, the cartridge-supporting body 16, the intermediate transfer belt 44, the belt-cleaning unit 144, and the waste toner cartridge 141.

Each of the four process cartridges 21 includes the photosensitive drum 25, and the drum-cleaning unit 81 for collecting waste toner from the photosensitive drum 25.

As shown in FIGS. 1 and 8, the cartridge-supporting body 16 is configured to support the four process cartridges 21 while being able to move between the internal position inside the main casing 2 and the external position outside the main casing 2.

The intermediate transfer belt 44 is disposed in a position for confronting the four photosensitive drums 25 when the cartridge-supporting body 16 is in the internal position while supporting the process cartridges 21.

The belt-cleaning unit 144 is configured to collect waste toner from the surface of the intermediate transfer belt 44.

As shown in FIG. 2, the waste toner cartridge 141 is configured to accommodate waste toner recovered from the photosensitive drums 25 by the corresponding drum-cleaning units 81, and waste toner recovered from the intermediate transfer belt 44 by the belt-cleaning unit 144.

The cartridge-supporting body 16 also includes the collective conveying unit 64 that aggregates and consolidates waste toner collected from the photosensitive drums 25 by the corresponding drum-cleaning units 81 for all four process cartridges 21 and that conveys this consolidated waste toner to the waste toner cartridge 141.

This construction enables the printer 1 to consolidate all waste toner collected from the four photosensitive drums 25 by the corresponding drum-cleaning units 81 and waste toner collected from the intermediate transfer belt 44 by the belt-cleaning unit 144 into a single waste toner cartridge 141.

Hence, this construction enables the printer 1 to be made more compact than a structure in which the receptacle for collecting waste toner from the four photosensitive drums 25 is provided separately from a receptacle for collecting waste toner from the intermediate transfer belt 44.

Further, providing a single receptacle for collecting waste toner rather than a plurality of receptacles makes disposal of the waste toner easier.

(2) As shown in FIGS. 2 and 5, the coupling unit 140 in the printer 1 having the above structure couples the belt-cleaning unit 144 and the collective conveying unit 64 with the waste toner cartridge 141 when the cartridge-supporting body 16 is in the internal position.

The coupling unit 140 is configured to convey waste toner collected from the photosensitive drums 25 by the corresponding drum-cleaning units 81 and waste toner collected from the intermediate transfer belt 44 by the belt-cleaning unit 144 to the waste toner cartridge 141. Providing the coupling unit 140 described above can consolidate all waste toner through a simple configuration.

(3) As shown in FIG. 5, the coupling unit 140 is provided with the coupling tube 160 for allowing passage of waste toner therethrough. The coupling tube 160 further includes the first coupling hole 167 that receives waste toner from the belt-cleaning unit 144, the collective receiving opening 170 that receives waste toner conveyed by the collective conveying unit 64, and the second coupling hole 168 through which this waste toner is supplied into the waste toner cartridge 141.

With this construction, waste toner supplied from the belt-cleaning unit 144 and waste toner conveyed by the collective conveying unit 64 can be collectively conveyed to the waste toner cartridge 141 through the second coupling hole 168. Thus, this construction reduces the risk of waste toner falling out of the device.

(4) As shown in FIG. 3, the drum-cleaning units 81 are configured to convey waste toner collected from the corresponding photosensitive drums 25 leftward. This arrangement enables waste toner collected from the photosensitive drums 25 by the corresponding drum-cleaning units 81 to be reliably consolidated.

(5) As shown in FIG. 5, the belt-cleaning unit 144 is configured to convey waste toner collected from the intermediate transfer belt 44 leftward. Hence, this configuration can reliably consolidate waste toner collected from the intermediate transfer belt 44 by the belt-cleaning unit 144.

(6) As shown in FIG. 2, the collective conveying unit 64 is configured to convey waste toner collected from the photosensitive drums 25 by the corresponding drum-cleaning units 81 in the front-rear direction. By configuring the collective conveying unit 64 to convey waste toner rearward, waste toner collected from the four photosensitive drums 25 can be reliably consolidated in the collective conveying unit 64.

(7) As shown in FIGS. 1 and 3, each of the drum-cleaning units 81 includes a drum-cleaning blade 88 that collects waste toner from the corresponding photosensitive drum 25, and a drum-cleaning screw 89 that conveys waste toner collected from the corresponding photosensitive drum 25 by the drum-cleaning blade 88 leftward. Thus, the drum-cleaning blade 88 scrapes waste toner off the corresponding photosensitive drum 25, and the drum-cleaning screw 89 conveys this waste toner leftward. Hence, this construction can reliably consolidate waste toner collected from the photosensitive drums 25.

(8) As shown in FIGS. 1 and 5, the belt-cleaning unit 144 includes the belt-cleaning blade 146 that recovers waste toner from the intermediate transfer belt 44, and the belt-cleaning screw 148 that conveys the waste toner collected from the intermediate transfer belt 44 by the belt-cleaning blade 146 leftward. Thus, the belt-cleaning blade 146 scrapes waste toner off the intermediate transfer belt 44, while the belt-cleaning screw 148 conveys the waste toner leftward. Hence, this construction can reliably convey waste toner collected from the intermediate transfer belt 44 to the waste toner cartridge 141.

(9) As shown in FIG. 2, the collective conveying unit 64 includes the collective conveying tube 98 elongated in the front-rear direction and configured to allow passage of waste toner therethrough, and the collective conveying screw 99 accommodated in the collective conveying tube 98 and configured to convey waste toner collected from the photosensitive drums 25 by the drum-cleaning units 81 rearward. Since the collective conveying screw 99 is configured to convey waste toner collected from the four photosensitive drums 25 rearward, the collective conveying unit 64 having the above construction can reliably consolidate the waste toner collected from the photosensitive drums 25 inside the collective conveying tube 98.

(10) As shown in FIG. 3, the collective conveying tube 98 is provided with the four input cylinders 100 that protrude from the circumferential surface of the collective conveying tube 98 at positions corresponding to the four drum-cleaning units 81. The input cylinders 100 receive waste toner from the corresponding drum-cleaning units 81. Accordingly, through a simple construction, the printer 1 can consolidate waste toner from the four drum-cleaning units 81.

(11) As shown in FIGS. 2 and 3, the main casing 2 is provided with the pair of positioning plates 114 for positioning the four photosensitive drums 25. The positioning plates 114 are elongated in the front-rear direction and the left positioning plate 114 is positioned on the inside (right side) of the collective conveying unit 64. This configuration reduces the likelihood of the collective conveying unit 64 coming into contact with other members in the main casing 2 when the cartridge-supporting body 16 is moved between the internal and external positions.

(12) As shown in FIG. 3, the cartridge-supporting body 16 includes the left side support-body wall 67 and the right side support-body wall 67. The positioning plates 114 are disposed between the left side support-body wall 67 and the right side support-body wall 67, and the collective conveying unit 64 is disposed in a position overlapping the left side support-body wall 67 vertically. This arrangement can suppress an increase in the left-right dimension of the cartridge-supporting body 16. Hence, the collective conveying unit 64 is even less likely to contact other members in the main casing 2 when the cartridge-supporting body 16 is moved between the internal and external positions.

(13) As shown in FIGS. 1 and 8, the belt-cleaning unit 144 is disposed rearward of the rearmost photosensitive drum 25. This arrangement can suppress contact between the cartridge-supporting body 16 and the belt-cleaning unit 144 when the cartridge-supporting body 16 is moved between the internal and the external positions.

(14) As shown in FIGS. 1 and 8, the waste toner cartridge 141 is also disposed rearward of the rearmost photosensitive drum 25. Hence, this arrangement can suppress contact between the cartridge-supporting body 16 and waste toner cartridge 141 when the cartridge-supporting body 16 is moved between the internal and external positions.

(15) As shown in FIGS. 5 and 6, the waste toner cartridge 141 can be detachably mounted in the main casing 2. Thus, the waste toner cartridge 141 can easily be removed for maintenance when waste toner has accumulated therein.

Since the waste toner cartridge 141 is detachably mounted in the main casing 2 and collects waste toner removed from all photosensitive drums 25 by the corresponding drum-cleaning units 81, there is less chance that the user will become soiled by waste toner on a portion other than the neighborhood of the waste toner cartridge 141 when removing the waste toner cartridge 141.

9. Second Embodiment (1) Constructions of Printer According to Second Embodiment Next, a second embodiment of the image forming apparatus will be described with reference to FIGS. 9 through 11, wherein like parts and components are designated with the same reference numerals to avoid duplicating description. Further, drawings in connection to the second embodiment are not sufficient unlike the drawings in connection to the first embodiment. However, several drawings for the first embodiment are also available for the second embodiment.

In the printer 1 according to the first embodiment described above, the process cartridges 21 provided with photosensitive drums 25 are detachably mountable in the support-body frame 63 of the cartridge-supporting body 16, as illustrated in FIGS. 4 and 8. When the process cartridges 21 are mounted in the support-body frame 63, the communication holes 94 of the corresponding drum-cleaning units 81 overlap the inlets 104 formed in the collective conveying unit 64, as shown in FIG. 3. Consequently, the drum-cleaning frames 87 of the four drum-cleaning units 81 are configured to communicate with the collective conveying tube 98 of the collective conveying unit 64.

Figure 9:
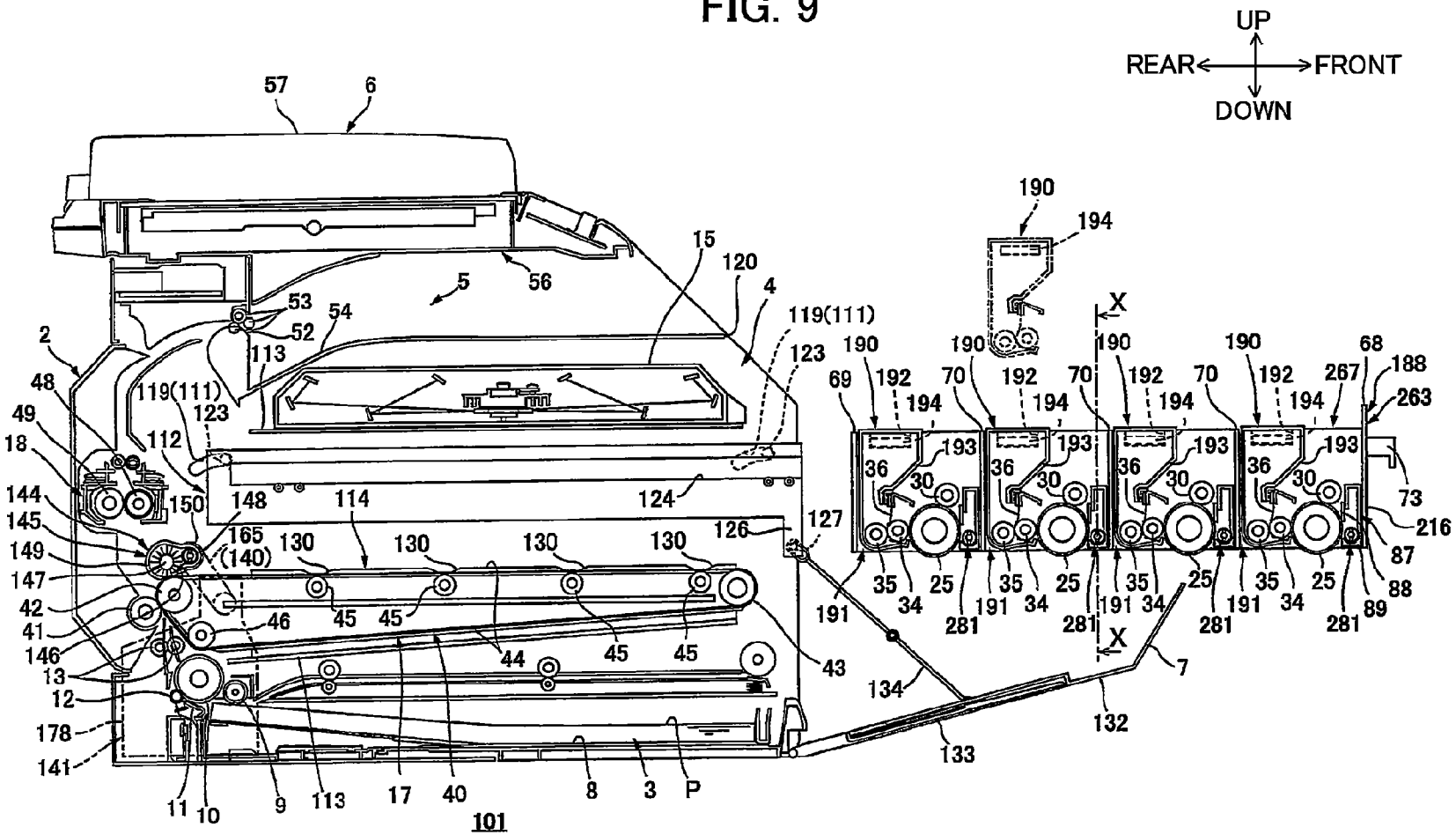
FIG. 9 is a cross-sectional view of a printer as an example of an image forming apparatus according to a second embodiment of the present invention and showing an external position of a drawer unit.

In a printer 101 according to the second embodiment, the cartridge-supporting body 16, the four process cartridges 21, and the drum-cleaning unit 81 are replaced with a drawer unit 188, four developing cartridges 190, and four drum-cleaning units 281, as shown in FIG. 9. That is, the support-body frame 63 is replaced with a cartridge-supporting body 216 in the printer 101.

Further, the developing cartridges 190 are not provided with the photosensitive drum 25, charging roller 30, and drum-cleaning unit 281. Rather, the drawer unit 188 is configured to support the four developing cartridges 190 in addition to a support-body frame 263, the four photosensitive drums 25, the four charging rollers 30, four drum-cleaning units 281, and a collective conveying unit 264.

(1-1) Structure of the Drawer Unit

The cartridge-supporting body 216 has the same construction as that of the cartridge-supporting body 16 except that the support-body frame 63 and the collective conveying unit 64 are replaced with the support-body frame 263 and the collective conveying unit 264. As with the support-body frame 63 in the first embodiment described above, the support-body frame 263 includes a pair of side support-body walls 267, the front support-body wall 68, the rear support-body wall 69, and the three partitioning support-body walls 70. In the cartridge-supporting body 216, spaces in the support-body frame 263 surrounded by neighboring partitioning support-body walls 70 and the pair of side support-body walls 267 are defined as developing-cartridge accommodating sections 191. In addition, the space in the front end of the support-body frame 63 surrounded by the front support-body wall 68, the forwardmost partitioning support-body wall 70, and the pair of side support-body walls 267 is defined as a developing-cartridge accommodating section 191, and the space in the rear end of the support-body frame 263 surrounded by the rear support-body wall 69, the rearmost partitioning support-body wall 70, and the pair of side support-body walls 267 is defined as a developing-cartridge accommodating section 191. Hence, four developing-cartridge accommodating sections 191 are juxtaposed in the support-body frame 263 in the front-rear direction. The four developing cartridges 190 can be detachably mounted in corresponding developing-cartridge accommodating sections 191 formed in the support-body frame 263.

Figure 10:
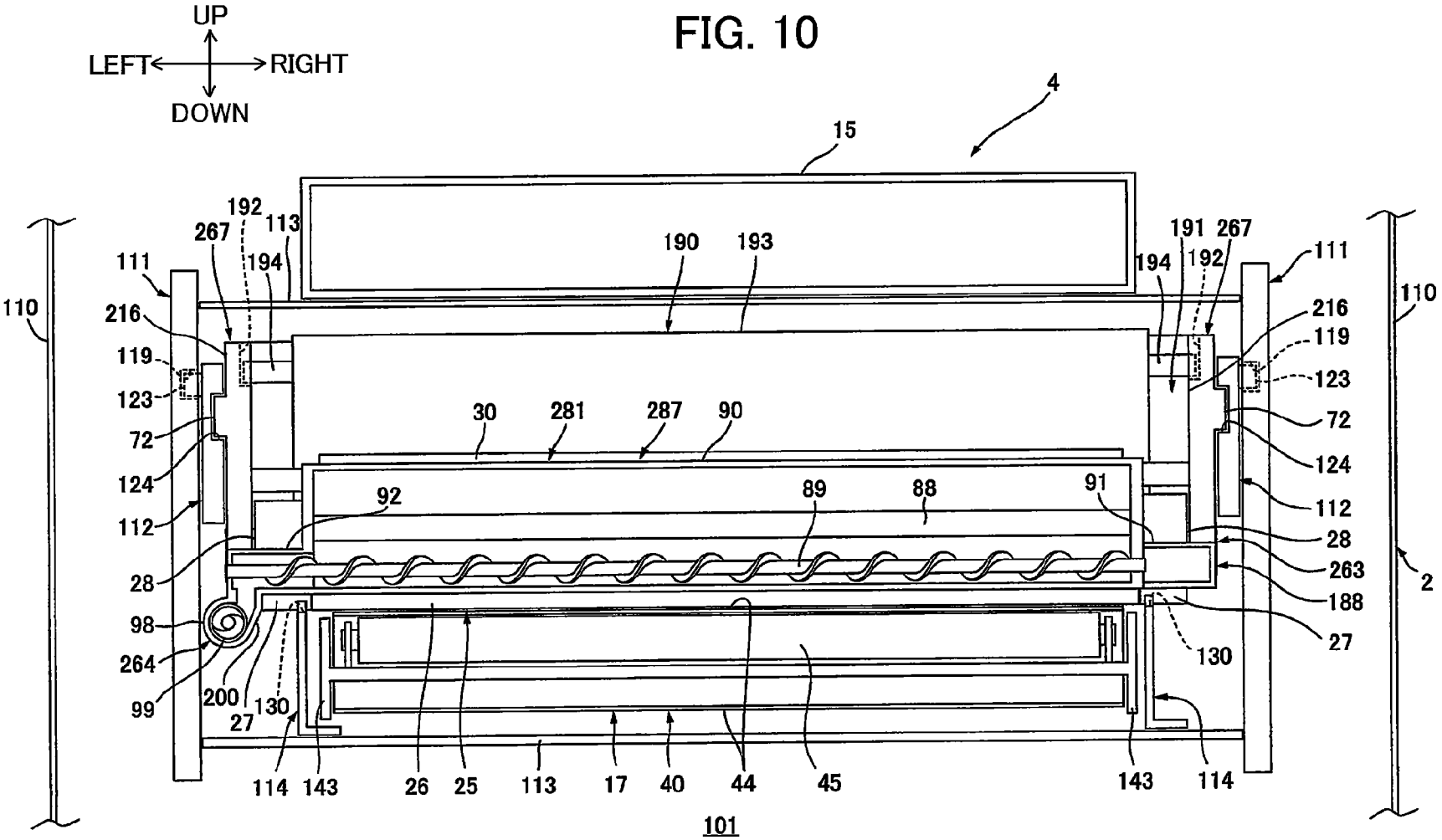
FIG. 10 is a cross-sectional view taken along a line X-X in FIG. 9 showing an assembled state of a developing cartridge with respect to a drawer unit.

As shown in FIGS. 9 and 10, each of the side support-body walls 267 constituting the support-body frame 263 is provided with a receiving groove 192 for each of the four developing-cartridge accommodating sections 191. The receiving grooves 192 receive corresponding engaging protrusions 194 formed on developing frames 193 described later.

The receiving grooves 192 are recesses formed in the inner left-right surfaces of the corresponding side support-body walls 267 and are positioned in the rear portion of the corresponding developing-cartridge accommodating section 191. The receiving grooves 192 have a general squared U-shape in a plan view that is open on both the top and the inner left-right side. In other words, four receiving grooves 192 are formed in each of the side support-body walls 267 at intervals in the front-rear direction, as shown in FIG. 9.

Figure 11:
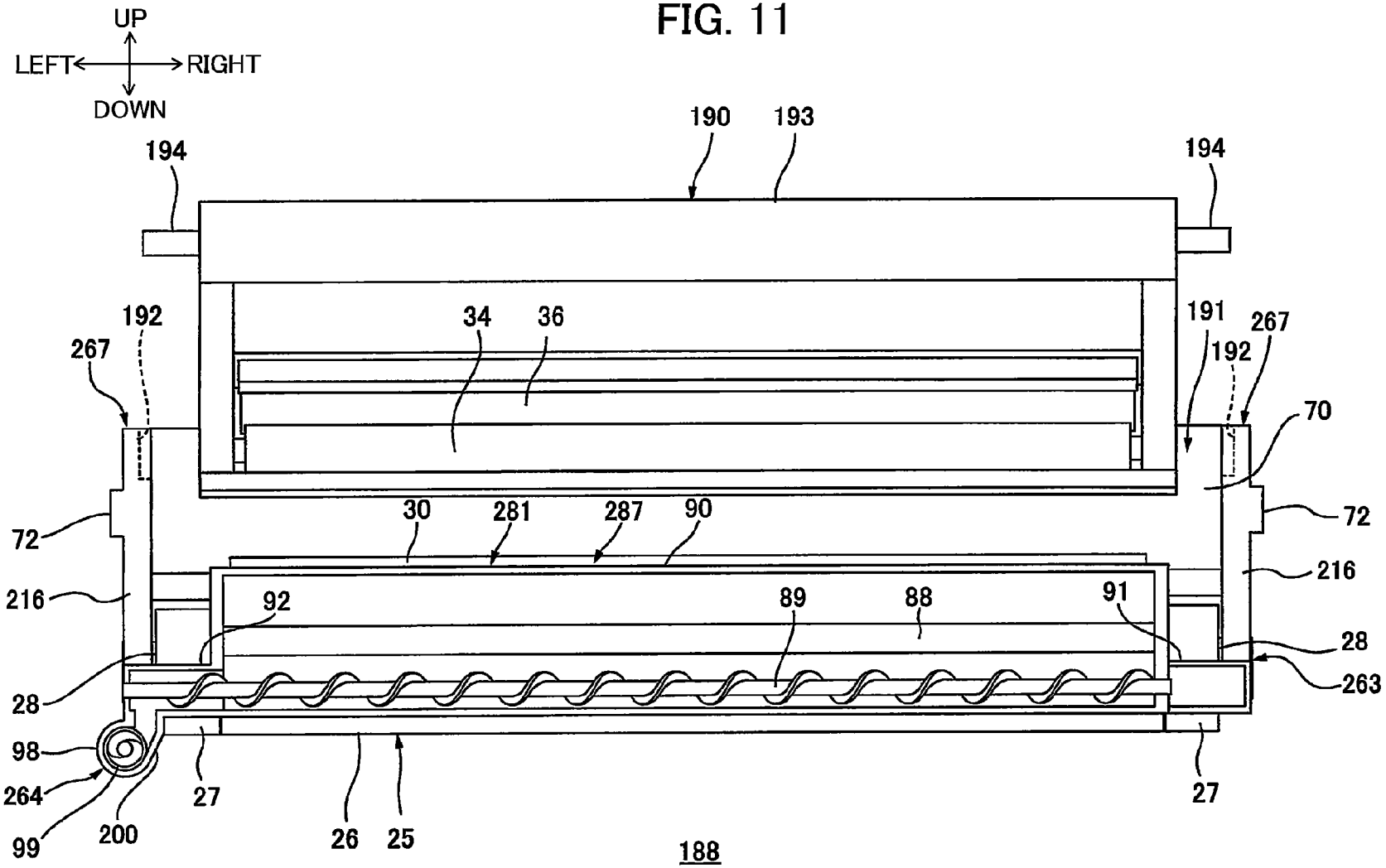
FIG. 11 is a cross-sectional view taken along the line X-X in FIG. 9 showing a disassembled state of the developing cartridge with respect to the drawer unit.

The photosensitive drums 25 are respectively provided in the bottom ends of the corresponding developing-cartridge accommodating sections 191. As shown in FIGS. 10 and 11, the photosensitive drums 25 are rotatably supported in the support-body frame 263, with the left and right ends of the drum shafts 28 supported in the corresponding side support-body walls 267. Consequently, the four photosensitive drums 25 are arranged parallel to each other and are spaced at intervals in the front-rear direction, as shown in FIG. 9. Further, the photosensitive drums 25 are arranged such that the bottom surfaces of the drum bodies 26 and the bottom ends of the flanges 27 are lower than the bottom end of the support-body frame 263.

The charging rollers 30 are disposed on the upper front sides of the corresponding photosensitive drums 25. As shown in FIGS. 10 and 11, the charging rollers 30 are rotatably supported in the support-body frame 263, with their left and right ends supported in the corresponding side support-body walls 267.

As shown in FIG. 9, the drum-cleaning units 281 are disposed in the lower front region of the corresponding developing-cartridge accommodating sections 191 and are in front of the corresponding photosensitive drums 25. The drum-cleaning unit 281 has the same construction as that of the drum-cleaning unit 81 except that the drum-cleaning frame 87 is replaced with a drum-cleaning frame 87. As shown in FIGS. 10 and 11, the drum-cleaning units 281 are supported in the support-body frame 263 such that the right frame protrusion 91 of the drum-cleaning frame 287 is formed continuously with the right side support-body wall 267, and the left frame protrusion 92 of the drum-cleaning frame 287 is formed continuously with the left side support-body wall 267.

With the four drum-cleaning units 281 and the collective conveying unit 264 supported in the support-body frame 263 in this way, the left frame protrusions 92 of the drum-cleaning units 281 are connected to the corresponding input cylinders 200 of the collective conveying unit 264. Hence, the drum-cleaning frames 287 of the four drum-cleaning units 281 are connected and capable of communicating with the collective conveying tube 98 of the collective conveying unit 264.

(1-2) Detailed Description of the Developing Cartridges

As shown in FIG. 9, each developing cartridge 190 includes a developing frame 193 in addition to the developing roller 34, the supply roller 35, and the thickness-regulating blade 36 described above.

The developing frame 193 is configured to accommodate toner therein. As shown in FIGS. 9 and 11, the developing frame 193 has a box-like shape that is elongated in the left-right direction. An opening is formed in the front wall of the developing frame 193 at the bottom end thereof. The opening spans the entire left-right dimension of the developing frame 193 and penetrates the front wall in the front-rear direction. The developing frame 193 includes a pair of engaging protrusions 194 that are configured to engage in the corresponding receiving grooves 192 formed in the side support-body walls 267.

One of the engaging protrusions 194 is provided on each outer left-right surface of the corresponding left and right side walls constituting the developing frame 193. The engaging protrusions 194 are ridge-like members that are elongated in the front-rear direction and protrude outward in the left-right direction. The engaging protrusions 194 have a slightly smaller front-rear dimension than the receiving grooves 192.

The developing rollers 34 are disposed in the lower front region of the corresponding developing cartridges 190, such that their front and upper surfaces are exposed through the opening formed in the developing cartridges 190. The left and right ends of the developing rollers 34 are supported in the left and right side walls constituting the corresponding developing cartridges 190.

The supply rollers 35 are disposed in the lower rear region of the corresponding developing cartridges 190. The left and right ends of the supply rollers 35 are supported in the left and right side walls of the corresponding developing cartridges 190.

The thickness-regulating blades 36 are fixed to the upper peripheral edges defining the openings in the corresponding developing cartridges 190.

As shown in FIGS. 9 and 10, each of the developing cartridges 190 is accommodated in the corresponding developing-cartridge accommodating section 191 with the pair of engaging protrusions 194 provided on the developing frame 193 received in the corresponding pair of receiving grooves 192 formed in the support-body frame 263. In this way, the developing cartridges 190 can be detachably accommodated in the support-body frame 263.

The collective conveying unit 264 is configured to consolidate all waste toner and other deposited matter removed from the drum bodies 26 of the photosensitive drums 25 by the corresponding drum-cleaning units 281 in the collective conveying tube 98 and to convey this deposited matter together through the collective conveying tube 98.

(2) Operational Advantages of the Second Embodiment

As shown in FIG. 9, the printer 101 according to the second embodiment includes the main casing 2, the four developing cartridges 190, the drawer unit 188, the intermediate transfer belt 44, the belt-cleaning unit 144, and the waste toner cartridge 141.

The four developing cartridges 190 are each configured to accommodate toner.

The drawer unit 188 is provided with the four photosensitive drums 25, and the four drum-cleaning units 281 that are provided to correspond to the four photosensitive drums 25 and are configured to collect waste toner from the photosensitive drums 25. The drawer unit 188 is also configured to support the four developing cartridges 190, while capable of being moved between the internal position inside the main casing 2 and the external position outside the main casing 2.

The intermediate transfer belt 44 is disposed so as to oppose the four photosensitive drums 25 when the drawer unit 188 is in the internal position.

The belt-cleaning unit 144 is configured to collect waste toner from the surface of the intermediate transfer belt 44.

The waste toner cartridge 141 is configured to accommodate waste toner collected from the photosensitive drums 25 by the corresponding drum-cleaning units 281, and waste toner collected from the intermediate transfer belt 44 by the belt-cleaning unit 144.

The drawer unit 188 is also provided with the collective conveying tube 98 that is configured to collectively convey waste toner collected by the four drum-cleaning units 281 to the waste toner cartridge 141.

This construction enables the printer 101 to consolidate all waste toner collected from the four photosensitive drums 25 by the corresponding drum-cleaning units 281 and waste toner collected from the intermediate transfer belt 44 by the belt-cleaning unit 144 into a single waste toner cartridge 141.

Hence, this construction enables the printer 101 to be made more compact than a structure in which the receptacle for collecting waste toner from the photosensitive drums 25 is provided separately from a receptacle for collecting waste toner from the intermediate transfer belt 44.

Further, providing a single receptacle for collecting waste toner rather than a plurality of receptacles makes disposal of the waste toner easier.

The printer 101 according to the second embodiment can obtain the same operational advantages as the printer 1 according to the first embodiment described above.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a main frame;

a plurality of process cartridges including a plurality of photosensitive drums and a plurality of drum-cleaning units, the plurality of process cartridges being provided in one-to-one correspondence with the plurality of photosensitive drums, the plurality of photosensitive drums being provided in one-to-one correspondence with the plurality of drum-cleaning units, each of the plurality of drum-cleaning units being configured to collect waste toner on a corresponding photosensitive drum;

a cartridge-supporting body configured to support the plurality of process cartridges and be movable between an internal position inside the main frame and an external position outside of the main frame;

a belt configured to confront the plurality of process cartridges when the cartridge-supporting body supporting the plurality of process cartridges is in the internal position;

a belt cleaning unit configured to collect waste toner on the belt;

a waste toner cartridge configured to accommodate both waste toner collected from the plurality of photosensitive drums by the plurality of drum-cleaning units and waste toner collected from the belt by the belt cleaning unit; and a collective conveying unit provided in the cartridge-supporting body and configured to aggregate waste toner collected from the plurality of photosensitive drums by the plurality of drum-cleaning units and to convey collectively the aggregated waste toner to the waste toner cartridge, wherein the waste toner cartridge is provided in the main frame when the cartridge-supporting body is positioned at the internal position and when the cartridge-supporting body is positioned at the external position, and wherein the waste toner cartridge connects with the collective conveying unit when the cartridge-supporting body is positioned at the internal position, and the waste toner cartridge disconnects with the collective conveying unit when the cartridge-supporting body is positioned at the external position.

2. The image forming apparatus as claimed in claim 1, further comprising:

a coupling unit providing communication of the waste toner cartridge with the belt cleaning unit and the collective conveying unit such that the waste toner collected from the plurality of photosensitive drums by the plurality of drum-cleaning units and the waste toner collected from the belt by the belt cleaning unit are conveyed to the waste toner cartridge.

3. The image forming apparatus as claimed in claim 2, wherein the coupling unit comprises a coupling conveyance tube formed with a first opening through which the waste toner collected by the belt cleaning unit passes, a second opening through which the waste toner conveyed through the collective conveying unit passes, and a third opening through which the waste toner that has been passing through the first opening and the second opening is delivered to the waste toner cartridge.

4. The image forming apparatus as claimed in claim 1, wherein each of the plurality of photosensitive drums has an axis defining an axial direction; and wherein each of the plurality of drum-cleaning units is configured to convey the waste toner collected from the plurality of photosensitive drums in the axial direction, respectively.

5. The image forming apparatus as claimed in claim 1, wherein each of the plurality of photosensitive drums has an axis defining an axial direction; and wherein the belt cleaning unit is configured to convey the waste toner collected from the belt in the axial direction.

6. The image forming apparatus as claimed in claim 1, wherein, the plurality of photosensitive drums are arrayed in an array direction; and wherein the collective conveying unit is configured to convey the waste toner collected from the plurality of photosensitive drums by the plurality of drum-cleaning units in the array direction.

7. The image forming apparatus as claimed in claim 1, wherein each of the plurality of photosensitive drums has an axis defining an axial direction; and wherein each of the plurality of drum cleaning units comprises:

a drum cleaning member configured to collect the waste toner on the corresponding photosensitive drum; and a conveying member configured to convey the waste toner collected from the corresponding photosensitive drum by the drum cleaning member in the axial direction.

8. The image forming apparatus as claimed in claim 7, wherein the drum cleaning member comprises a drum cleaning blade.

9. The image forming apparatus as claimed in claim 7, wherein the conveying member comprises a screw feeder.

10. The image forming apparatus as claimed in claim 1, wherein each of the plurality of photosensitive drums has an axis defining an axial direction; and wherein the belt cleaning unit comprises:

a belt cleaning member configured to collect the waste toner on the belt; and a conveying member configured to convey the waste toner collected by the belt cleaning member in the axial direction.

11. The image forming apparatus as claimed in claim 10, wherein the belt cleaning member comprises a belt cleaning blade.

12. The image forming apparatus as claimed in claim 10, wherein the conveying member comprises a screw feeder.

13. The image forming apparatus as claimed in claim 1, wherein the plurality of photosensitive drums are arrayed in an array direction; and wherein the collective conveying unit comprises:

a collective conveying tube extending in the array direction and configured to allow the waste toner to pass therethrough, the collective conveying tube having an outer peripheral surface; and a collective conveying member positioned in the collective conveying tube and configured to convey the waste toner collected by the plurality of drum cleaning units in the array direction.

14. The image forming apparatus as claimed in claim 13, wherein the collective conveying tube includes a plurality of cylindrical parts protruding from the outer peripheral surface, the plurality of cylindrical parts and the plurality of drum-cleaning units being in one-to-one correspondence such that each of the plurality of cylindrical parts allows the waste toner collected by a corresponding drum-cleaning unit to pass therethrough.

15. The image forming apparatus as claimed in claim 14, wherein the collective conveying member comprises a screw feeder.

16. The image forming apparatus as claimed in claim 1, wherein the plurality of photosensitive drums are arrayed in an array direction, and each of the plurality of photosensitive drums has an axis defining an axial direction; and wherein the main frame further comprises a positioning member extending in the array direction and configured to perform positioning of the plurality of photosensitive drums, the positioning member being positioned inward of the collective conveying unit in the axial direction.

17. The image forming apparatus as claimed in claim 16, wherein the cartridge-supporting body further comprises a first side wall and a second side wall that are arranged in the axial direction;

wherein the positioning member is positioned between the first side wall and the second side wall in the axial direction; and wherein the collective conveying unit overlaps the first side wall when projected in a direction perpendicular to both the array direction and the axial direction.

18. The image forming apparatus as claimed in claim 1, wherein a direction from the external position to the internal position of the cartridge-supporting body is a moving direction; and wherein the plurality of photosensitive drums includes a most downstream photosensitive drum in the moving direction, the belt cleaning unit being positioned downstream of the most downstream photosensitive drum in the moving direction.

19. The image forming apparatus as claimed in claim 1, wherein a direction from the external position to the internal position of the cartridge-supporting body is a moving direction; and wherein the plurality of photosensitive drums includes a most downstream photosensitive drum in the moving direction, the waste toner cartridge being positioned downstream of the most downstream photosensitive drum in the moving direction.

20. The image forming apparatus as claimed in claim 1, wherein the waste toner cartridge is attachable to and detachable from the main frame.

21. The image forming apparatus as claimed in claim 1, further comprising a coupling tube configured to connect the waste toner cartridge and the collective conveying unit, wherein each of the plurality of photosensitive drums has an axis defining an axial direction, and wherein the coupling tube extends in the axial direction.

22. The image forming apparatus as claimed in claim 1, further comprising a second conveying unit connecting with the collective conveying unit when the cartridge-supporting body is positioned at the internal position, the second conveying unit disconnecting with the collective conveying unit when the cartridge-supporting body is positioned at the external position.

23. The image forming apparatus as claimed in claim 1, wherein the main frame further comprises a contact-separation mechanism configured to move, when the cartridge-supporting body supporting the plurality of process cartridges is positioned at the internal position, the cartridge-supporting body between a contact position where the plurality of photosensitive drums are in contact with the belt and a separated position where the plurality of photosensitive drums are out of contact with the belt, wherein the cartridge-supporting body takes the separated position when the cartridge-supporting body moves from the internal position to the external position.

24. The image forming apparatus as claimed in claim 1, wherein the cartridge-supporting body has a first guide rail and a second guide rail;

wherein the main frame further comprises:

a cover configured to cover a cartridge-supporting body access opening for moving the cartridge-supporting body from the internal position to the external position;

a first side wall having a first curved groove which extends in a direction sloping upward toward the cover;

a second side wall having a second curved groove corresponding to the first curved groove of the first side wall;

a first guide wall having a first guiding shaft which is movable within the first curved groove of the first side wall and receiving the first guide rail of the cartridge-supporting body so that the first guide rail can slide in a moving direction of the cartridge-supporting body;

a second guide wall having a second guiding shaft which is movable within the second curved groove of the second side wall and receiving the second guide rail of the cartridge-supporting body so that the second guide rail can slide in the moving direction of the cartridge-supporting body, wherein the first guiding shaft and the second guiding shaft make contact with the first curved groove and the second curved groove, respectively, when the cover is closed; and wherein the first guiding shaft and the second guiding shaft are separated away from the first curved groove and the second curved groove, respectively, when the cover is opened.

25. An image forming apparatus comprising:

a main frame;

a plurality of developing cartridges each configured to accommodate toner therein;

a drawer unit configured to support the plurality of developing cartridges and be movable between an internal position inside the main frame and an external position outside of the main frame, the drawer unit comprising:

a plurality of photosensitive drums; and a plurality of drum-cleaning units provided in one-to-one correspondence with the plurality of photosensitive drums, each of the plurality of drum-cleaning units being configured to collect waste toner on a corresponding photosensitive drum;

a belt configured to confront the plurality of photosensitive drums when the drawer unit supporting the plurality of developing cartridges is in the internal position;

a belt cleaning unit configured to collect waste toner on the belt;

a waste toner cartridge configured to accommodate both waste toner collected from the plurality of photosensitive drums by the plurality of drum-cleaning units and waste toner collected from the belt by the belt cleaning unit; and a collective conveying unit provided in the drawer unit and configured to aggregate waste toner collected from the plurality of photosensitive drums by the plurality of drum-cleaning units and to convey collectively the aggregated waste toner to the waste toner cartridge, wherein the waste toner cartridge is provided in the main frame when the drawer unit is positioned at the internal position and when the drawer unit is positioned at the external position; and wherein the waste toner cartridge connects with the collective conveying unit when the drawer unit is positioned at the internal position, and the waste toner cartridge disconnects with the collective conveying unit when the drawer unit is positioned at the external position.

26. The image forming apparatus as claimed in claim 25, further comprising:

a coupling unit providing communication of the waste toner cartridge with the belt cleaning unit and the collective conveying unit such that the waste toner collected from the plurality of photosensitive drums by the plurality of drum-cleaning units and the waste toner collected from the belt by the belt cleaning unit are conveyed to the waste toner cartridge.

27. The image forming apparatus as claimed in claim 26, wherein the coupling unit comprises a coupling conveyance tube formed with a first opening through which the waste toner collected by the belt cleaning unit passes, a second opening through which the waste toner conveyed through the collective conveying unit passes, and a third opening through which the waste toner that has been passing through the first opening and the second opening is delivered to the waste toner cartridge.

28. The image forming apparatus as claimed in claim 25, wherein each of the plurality of photosensitive drums has an axis defining an axial direction; and wherein each of the plurality of drum-cleaning units is configured to convey the waste toner collected from the plurality of photosensitive drums in the axial direction, respectively.

29. The image forming apparatus as claimed in claim 25, wherein each of the plurality of photosensitive drums has an axis defining an axial direction; and wherein the belt cleaning unit is configured to convey the waste toner collected from the belt in the axial direction.

30. The image forming apparatus as claimed in claim 25, wherein the plurality of photosensitive drums are arrayed in an array direction; and wherein the collective conveying unit is configured to convey the waste toner collected from the plurality of photosensitive drums by the plurality of drum-cleaning units in the array direction.

31. The image forming apparatus as claimed in claim 25, wherein each of the plurality of photosensitive drums has an axis defining an axial direction; and wherein each of the plurality of drum cleaning units comprises:

a drum cleaning member configured to collect the waste toner on the corresponding photosensitive drum; and a conveying member configured to convey the waste toner collected from the corresponding photosensitive drum by the drum cleaning member in the axial direction.

32. The image forming apparatus as claimed in claim 31, wherein the drum cleaning member comprises a drum cleaning blade.

33. The image forming apparatus as claimed in claim 31, wherein the conveying member comprises a screw feeder.

34. The image forming apparatus as claimed in claim 25, wherein each of the plurality of photosensitive drums has an axis defining an axial direction; and wherein the belt cleaning unit comprises:

a belt cleaning member configured to collect the waste toner on the belt; and a conveying member configured to convey the waste toner collected by the belt cleaning member in the axial direction.

35. The image forming apparatus as claimed in claim 34, wherein the belt cleaning member comprises a belt cleaning blade.

36. The image forming apparatus as claimed in claim 34, wherein the conveying member comprises a screw feeder.

37. The image forming apparatus as claimed in claim 25, wherein the plurality of photosensitive drums are arrayed in an array direction; and wherein the collective conveying unit comprises:

a collective conveying tube extending in the array direction and configured to allow the waste toner to pass therethrough, the collective conveying tube having an outer peripheral surface; and a collective conveying member positioned in the collective conveying tube and configured to convey the waste toner collected by the plurality of drum cleaning units in the array direction.

38. The image forming apparatus as claimed in claim 37, wherein the collective conveying tube includes a plurality of cylindrical parts protruding from the outer peripheral surface, the plurality of cylindrical parts and the plurality of drum-cleaning units being in one-to-one correspondence such that each of the plurality of cylindrical parts allows the waste toner collected by a corresponding drum-cleaning unit to pass therethrough.

39. The image forming apparatus as claimed in claim 38, wherein the collective conveying member comprises a screw feeder.

40. The image forming apparatus as claimed in claim 25, wherein the plurality of photosensitive drums are arrayed in an array direction, and each of the plurality of photosensitive drums has an axis defining an axial direction; and wherein the main frame further comprises a positioning member extending in the array direction and configured to perform positioning of the plurality of photosensitive drums, the positioning member being positioned inward of the collective conveying unit in the axial direction.

41. The image forming apparatus as claimed in claim 40, wherein the drawer unit further comprises a first side wall and a second side wall that are arranged in the axial direction;

wherein the positioning member is positioned between the first side wall and the second side wall in the axial direction; and wherein the collective conveying unit overlaps the first side wall when projected in a direction perpendicular to both the array direction and the axial direction.

42. The image forming apparatus as claimed in claim 25, wherein a direction from the external position to the internal position of the drawer unit is a moving direction; and wherein the plurality of photosensitive drums includes a most downstream photosensitive drum in the moving direction, the belt cleaning unit being positioned downstream of the most downstream photosensitive drum in the moving direction.

43. The image forming apparatus as claimed in claim 25, wherein a direction from the external position to the internal position of the drawer unit is a moving direction; and wherein the plurality of photosensitive drums includes a most downstream photosensitive drum in the moving direction, the waste toner cartridge being positioned downstream of the most downstream photosensitive drum in the moving direction.

44. The image forming apparatus as claimed in claim 25, wherein the waste toner cartridge is attachable to and detachable from the main frame.

45. The image forming apparatus as claimed in claim 25, further comprising a coupling tube configured to connect the waste toner cartridge and the collective conveying unit, wherein each of the plurality of photosensitive drums has an axis defining an axial direction, and wherein the coupling tube extends in the axial direction.

46. An image forming apparatus comprising:

a main frame;

a plurality of process cartridges including a plurality of photosensitive drums and a plurality of drum-cleaning units, the plurality of process cartridges being provided in one-to-one correspondence with the plurality of photosensitive drums, the plurality of photosensitive drums being provided in one-to-one correspondence with the plurality of drum-cleaning units, each of the plurality of drum-cleaning units being configured to collect waste toner on a corresponding photosensitive drum;

a cartridge-supporting body configured to support the plurality of process cartridges;

a waste toner cartridge configured to accommodate waste toner collected from the plurality of photosensitive drums by the plurality of drum-cleaning units; and a collective conveying unit provided in the cartridge-supporting body and configured to aggregate waste toner collected from the plurality of photosensitive drums by the plurality of drum-cleaning units and to convey collectively the aggregated waste toner to the waste toner cartridge, wherein the plurality of photosensitive drums are arrayed in an array direction, and each of the plurality of photosensitive drums has an axis defining an axial direction, and wherein the main frame further comprises a positioning member extending in the array direction and configured to perform positioning of the plurality of photosensitive drums, the positioning member being positioned inward of the collective conveying unit in the axial direction.

47. An image forming apparatus comprising:

a main frame;

a plurality of developing cartridges each configured to accommodate toner therein;

a cartridge-supporting body configured to support the plurality of developing cartridges, the cartridge-supporting body comprising:

a plurality of photosensitive drums; and a plurality of drum-cleaning units provided in one-to-one correspondence with the plurality of photosensitive drums, each of the plurality of drum-cleaning units being configured to collect waste toner on a corresponding photosensitive drum;

a waste toner cartridge configured to accommodate waste toner collected from the plurality of photosensitive drums by the plurality of drum-cleaning units; and a collective conveying unit provided in the cartridge-supporting body and configured to aggregate waste toner collected from the plurality of photosensitive drums by the plurality of drum-cleaning units and to convey collectively the aggregated waste toner to the waste toner cartridge, wherein the plurality of photosensitive drums are arrayed in an array direction, and each of the plurality of photosensitive drums has an axis defining an axial direction, and wherein the main frame further comprises a positioning member extending in the array direction and configured to perform positioning of the plurality of photosensitive drums, the positioning member being positioned inward of the collective conveying unit in the axial direction.

* * * * *